US007090323B2

(12) United States Patent
Takatsuka

(10) Patent No.: US 7,090,323 B2
(45) Date of Patent: Aug. 15, 2006

(54) LIQUID EJECTION HEAD AND IMAGE RECORDING APPARATUS

(75) Inventor: Tsutomu Takatsuka, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/059,549

(22) Filed: Feb. 17, 2005

(65) Prior Publication Data

US 2005/0190240 A1 Sep. 1, 2005

(30) Foreign Application Priority Data

Feb. 19, 2004 (JP) ..... 2004-043084

(51) Int. Cl.
*B41J 29/38* (2006.01)
*B41J 2/045* (2006.01)

(52) U.S. Cl. ..... 347/17; 347/68

(58) Field of Classification Search ..... 347/17, 347/67, 68

See application file for complete search history.

(56) References Cited

U.S. PATENT DOCUMENTS 5,467,112 A * 11/1995 Mitani ..... 347/1
2005/0259124 A1* 11/2005 Sekiguchi ..... 347/17

FOREIGN PATENT DOCUMENTS

JP 11-348269 A 12/1999
JP 2001-146012 A 5/2001
JP 2003-145783 A 5/2003

* cited by examiner

*Primary Examiner*—Lamson Nguyen
(74) *Attorney, Agent, or Firm*—Birch, Stewart, Kolasch & Birch, LLP

(57) ABSTRACT

The liquid ejection head comprises: a plurality of nozzles which eject droplets of liquid; a plurality of pressure chambers which are respectively connected to the nozzles; a common flow passage which supplies the liquid to the pressure chambers; a plurality of ejection devices which respectively cause the liquid in the pressure chambers to be ejected from the nozzles; a temperature differential generating device which generates a temperature differential between the common flow passage and each of the pressure chambers; a common flow passage temperature determining device which determines temperature of the common flow passage; a pressure chamber temperature determining device which determines temperature of each of the pressure chambers; and a control device which controls the temperature differential generating device in accordance with the temperature of the common flow passage and the temperature of each of the pressure chambers, in such a manner that the temperature differential between the common flow passage and each of the pressure chambers reaches a prescribed temperature differential.

10 Claims, 15 Drawing Sheets

LIQUID EJECTION HEAD AND IMAGE RECORDING APPARATUS

BACKGROUND OF THE INVENTION

1. Field of the Invention

The present invention relates to a liquid discharge head and an image recording apparatus, and more particularly to temperature adjustment in a liquid ejection head.

2. Description of the Related Art

An inkjet head (recording head) has a composition in which ink is supplied to pressure chambers connected to nozzles, and liquid droplets are ejected from the nozzles by applying a pressure change to the liquid inside the pressure chambers. If there is an air bubble inside a pressure chamber, the pressure required for ejection is not transmitted to the ink, and an ejection error thereby arises. In order to prevent ejection errors of this kind, an operation is performed in order to suction the ink containing air bubbles inside the pressure chambers and expel the air bubbles together with the ink (namely, a "suction operation"). However, there is a problem in that the amount of ink consumed increases when a suction operation is performed.

Japanese Patent Application Publication No. 2001-146012 discloses an inkjet head, in which a thermoelectric element unit having a plurality of Peltier elements is disposed in a position opposing the pressure generating chamber, on the other side of the base plate of the pressure generating chamber. When this thermoelectric unit is operated, the base plate of the pressure generating chamber is cooled and hence the ink inside the pressure generating chamber is cooled as this base plate is cooled. By cooling the ink, it is possible to increase the solubility of the air of the air bubbles in the ink. When the thermoelectric unit is driven, heat is generated in the portion of the thermoelectric unit adjacent to the flow path unit, and this heat is transmitted successively through an ink supply port forming substrate, an ink chamber forming substrate and a nozzle plate, which are made from metallic members having more thermal conductivity than a ceramic member, and the heat is dissipated from the nozzle plate.

However, in Japanese Patent Application Publication No. 2001-146012, air bubbles are generated because the common ink chamber (common flow passage) is heated during ejection recording. If the ink supply port becomes covered by an air bubble, then ink is not supplied to the pressure chamber and an ejection failure may occur. Moreover, since the viscosity of the ink in the common ink passage becomes lower than the viscosity of the ink in the pressure generating chamber (pressure chamber), when ink is ejected from the nozzle, then the ink is liable to reflux into the common ink chamber, and hence the pressure in the pressure generating chamber may not be directed effectively towards ejection.

SUMMARY OF THE INVENTION

The present invention has been contrived in view of such circumstances, and an object thereof is to provide a structure of a liquid ejection head and an image recording apparatus using the head, whereby generation of air bubbles in the head, and particularly in the common flow passage, can be avoided, and pressure loss caused by reflux of ink from the supply port into the common flow passage can be suppressed.

In order to attain the aforementioned object, the present invention is directed to a liquid ejection head, comprising: a plurality of nozzles which eject droplets of liquid; a plurality of pressure chambers which are respectively connected to the nozzles; a common flow passage which supplies the liquid to the pressure chambers; a plurality of ejection devices which respectively cause the liquid in the pressure chambers to be ejected from the nozzles; a temperature differential generating device which generates a temperature differential between the common flow passage and each of the pressure chambers; a common flow passage temperature determining device which determines temperature of the common flow passage; a pressure chamber temperature determining device which determines temperature of each of the pressure chambers; and a control device which controls the temperature differential generating device in accordance with the temperature of the common flow passage and the temperature of each of the pressure chambers, in such a manner that the temperature differential between the common flow passage and each of the pressure chambers reaches a prescribed temperature differential.

According to the present invention, the temperature differential between the pressure chamber and the common flow passage is controlled in such a manner that it reaches a prescribed temperature differential. Therefore, if the temperature differential is controlled in such a manner that the pressure chamber is hotter than the common flow passage by a prescribed temperature or less (for example, by 10° C. or less), then the viscosity of the liquid in the common flow passage can be made higher than the viscosity of the liquid in the pressure chamber, and pressure loss caused by reflux of the liquid from the pressure chamber into the common flow passage during liquid ejection can be prevented. Furthermore, if the temperature in the common flow passage is lower than the temperature of the pressure chamber, then it is possible to suppress the formation of air bubbles in the common flow passage when the liquid resides in the passage for a long period of time, and furthermore, it is also possible to eject a liquid of high viscosity from the pressure chamber. On the other hand, if the temperature of the pressure chamber is lower than the temperature of the common flow passage, then air bubbles inside the pressure chamber, which may cause liquid ejection failures, can be made to dissolve into the liquid.

Preferably, the temperature differential generating device comprises: a pressure chamber heating device which heats each of the pressure chambers, the pressure chamber heating device being joined to one face of each of the pressure chambers; and a Peltier element of which heat absorbing face is joined to one face of the common flow passage.

According to the present invention, it is possible to control the temperature differential in such a manner that a prescribed temperature differential is produced between the pressure chamber and the common flow passage, by heating the pressure chamber by means of the pressure chamber heating device and by cooling the common flow passage by means of the Peltier effect of the Peltier element. The prescribed temperature differential may be set appropriately in accordance with the amount of thermal energy generated by the pressure chamber heating device and the temperature differential generated between the heat absorbing side and the heat generating side of the Peltier element.

Alternatively, it is also preferable that the temperature differential generating device comprises a Peltier element disposed in a layer between the common flow passage and each of the pressure chambers, the Peltier element having a heat generating face which is joined to one face of each of the pressure chambers and a heat absorbing face which is joined to one face of the common flow passage. According to this, it is possible to control the temperature differential in such a manner that a prescribed temperature differential is produced between the pressure chamber and the common flow passage, by heating the pressure chamber and cooling the common flow passage by means of the Peltier effect of the Peltier element. Moreover, it is preferable that the liquid ejection head further comprises a nozzle heating device which heats a nozzle plate in which the nozzles are provided. According to this, since the nozzle heating device heats the nozzle plate, it is possible to lower the viscosity of the liquid by raising the temperature in the vicinity of the ejection port of the nozzle, and hence ejection performance can be improved.

Alternatively, it is also preferable that the temperature differential generating device comprises a first Peltier element disposed in a same layer as the common flow passage, the first Peltier element having a heat generating face which is joined to one face of each of the pressure chambers and a heat absorbing face which is joined to one face of a thermal conducting member connected to the common flow passage.

According to the present invention, it is possible to control the temperature differential in such a manner that a prescribed temperature differential is produced between the pressure chamber and the common flow passage, by heating the pressure chamber and cooling the common flow passage, via the thermal conducting member, by means of the Peltier effect of the Peltier element. Furthermore, since the Peltier element is disposed in the same layer as the common flow passage, the number of layers in the liquid ejection head can be reduced and the head can be made more compact.

Preferably, the temperature differential generating device further comprises a second Peltier element having a heat absorbing face which is joined to the other face of the thermal conducting member. According to this, the cooling of the common flow passage can be promoted further, and therefore a temperature differential can be generated more readily between the pressure chamber and the common flow passage.

Preferably, the liquid ejection head further comprises: a heating and cooling device which heats or cools the common flow passage, wherein: the common flow passage branches from a main flow of a liquid flow passage which supplies the liquid; and the control device causes the common flow passage to be heated or cooled by controlling the heating and cooling device in such a manner that temperature at a prescribed position of the common flow passage reaches a prescribed target temperature according to a distance from the main flow to the prescribed position of the common flow passage.

According to the present invention, it is possible to make the temperature inside the common flow passage gradually higher, as the distance from the main flow increases, for example. In this case, the fluid resistance can be reduced by heating the liquid flowing at a position that is distant from the main flow. Therefore, the liquid can be supplied in a stable fashion, even at a position that is distant from the main flow.

Preferably, the control device controls the heating and cooling device in such a manner that the temperature at the prescribed position of the common flow passage reaches a temperature within a temperature range according to the distance from the main flow to the prescribed position in the common flow passage.

According to the present invention, since the temperature at a prescribed position in the common flow passage is controlled so that it reaches a temperature within a temperature range according to the distance from the main flow of the liquid flow passage, it is possible to make the temperature converge gradually to a target temperature, as the distance from the main flow increases, for example. Therefore, it is possible to prevent adverse effects on image formation caused by fluctuation in the temperature of the liquid ejected at respective nozzles.

Preferably, the liquid ejection head further comprises a liquid supply device which supplies a liquid for preventing evaporation of the liquid to be ejected, to a vicinity of an ejection port of each of the nozzles. According to this present invention, it is possible to prevent the occurrence of ejection failures as a result of drying of the liquid in the vicinity of the ejection port.

The present invention is also directed to an image recording apparatus comprising the above-described liquid ejection head.

The liquid ejected from the liquid ejection head may be various types of liquid, such as ink, developer processing liquid, a functional liquid, or the like.

According to the present invention, the temperature differential between the pressure chamber and the common flow passage is controlled in such a manner that it reaches a prescribed temperature differential. Therefore, if the temperature differential is controlled in such a manner that the pressure chamber is hotter than the common flow passage by a prescribed temperature or less, then the viscosity of the liquid in the common flow passage can be made higher than the viscosity of the liquid in the pressure chamber, and reflux of the liquid from the pressure chamber into the common flow passage during liquid ejection can be prevented. Furthermore, convection is produced inside the common flow passage by the temperature differential between the pressure chamber and the common flow passage, and formation of air bubbles can be prevented.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

The First Embodiment of the Present Invention

Figure 1:
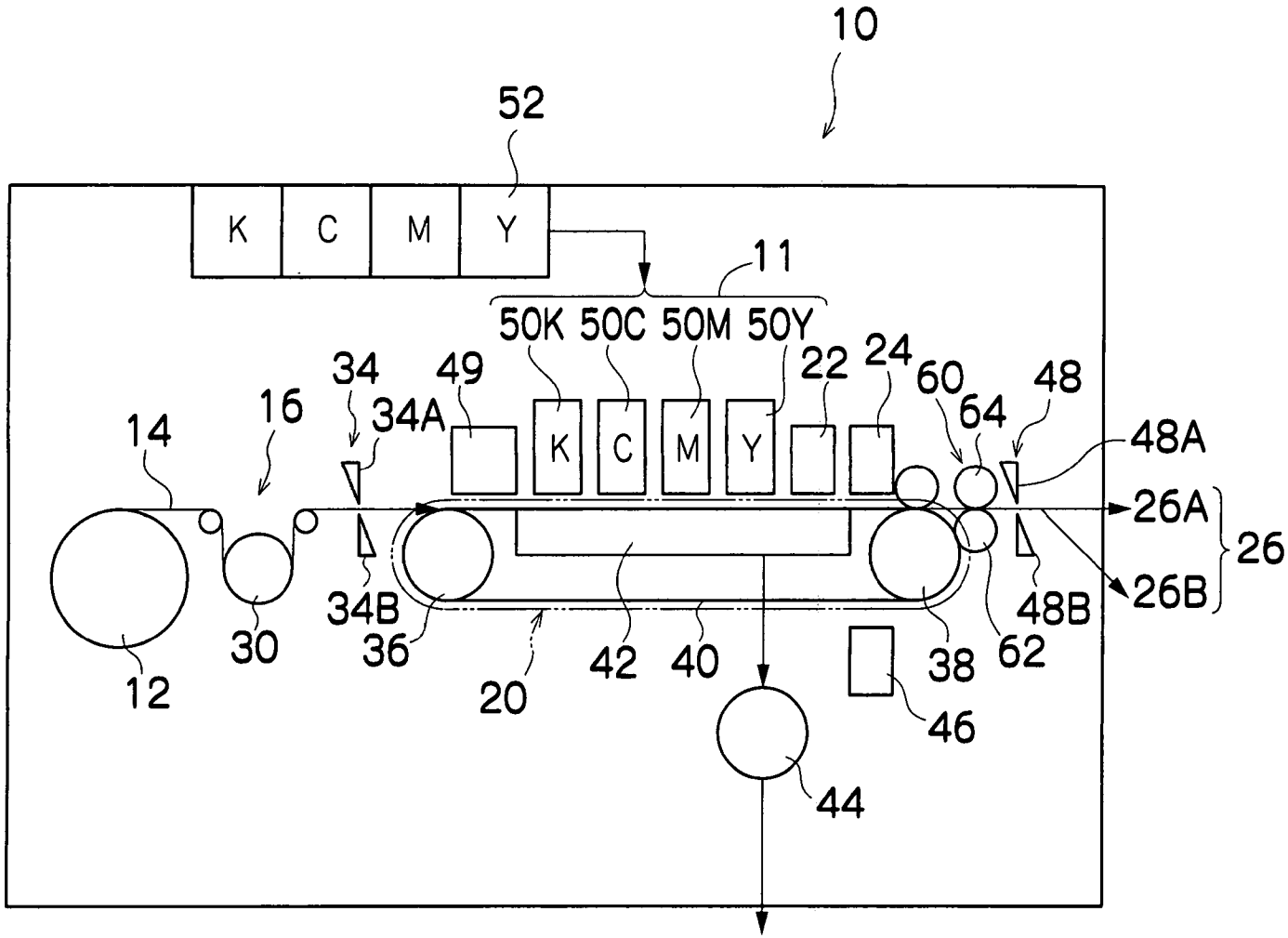
FIG. 1 is a general schematic drawing of an inkjet recording apparatus according to an embodiment of the present invention.

FIG. 1 is a general schematic drawing of an inkjet recording apparatus according to an embodiment of the present invention.

The inkjet recording apparatus 10 is a printer to record data of image and the like by ejecting the ink liquid droplet onto the recording paper 14, and comprises: a paper supply unit 12 for supplying recording paper 14; a decurling unit 16 for removing curl in the recording paper 14; a print unit 11 having a plurality of print heads 50K, 50C, 50M, and 50Y for ink colors of black (K), cyan (C), magenta (M), and yellow (Y), respectively; a suction belt conveyance unit 20 disposed facing the nozzle face (ink-droplet ejection face) of the print unit 11, for conveying the recording paper 14 while keeping the recording paper 14 flat; a post-drying unit 24 for applying after-treatment to the printed recording paper 14; and a print determination unit 22 for reading the printed result produced by the print unit 11; and a paper output unit 26 for outputting image-printed recording paper 14 to the exterior.

In FIG. 1, a single magazine for rolled paper (continuous paper) is shown as an example of the paper supply unit 12; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of recording paper 14 can be used, it is preferable that an information recording medium such as a bar code and a wireless tag containing information about the type of the recording paper 14 is attached to the magazine, and by reading the information contained in the information recording medium with a predetermined reading device, the type of the recording paper 14 to be used is automatically determined, and ink-droplet ejection is controlled so that the ink-droplets are ejected in an appropriate manner in accordance with the type of the recording paper 14.

In the case of the configuration in which roll paper is used, a cutter (first cutter) 34 is provided as shown in FIG. 1, and the continuous paper is cut into a desired size by the cutter 34. The cutter 34 has a stationary blade 34B, of which length is equal to or greater than the width of the conveyor pathway of the recording paper 14, and a round blade 34A, which moves along the stationary blade 34B. The stationary blade 34B is disposed on the reverse side of the printed surface of the recording paper 14, and the round blade 34A is disposed on the printed surface side across the conveyor pathway. When cut paper is used, the cutter 34 is not required.

The recording paper 14 delivered from the paper supply unit 18 retains curl due to having been loaded in the magazine. In order to remove the curl, heat is applied to the recording paper 14 in the decurling unit 16 by a heating drum 30 in the direction opposite from the curl direction in the magazine. The heating temperature at this time is preferably controlled so that the recording paper 14 has a curl in which the surface on which the print is to be made is slightly round outward.

The decurled and cut recording paper 14 is delivered to the suction belt conveyance unit 20. The suction belt conveyance unit 20 has a configuration in which an endless belt 40 is set around rollers 36 and 38 so that the portion of the endless belt 40 facing at least the nozzle face of the print unit 11 and the sensor face of the print determination unit 22 forms a horizontal plane (flat plane).

The belt 40 has a width that is greater than the width of the recording paper 14, and a plurality of suction apertures (not shown) are formed on the belt surface. A suction chamber 42 is disposed in a position facing the sensor surface of the print determination unit 22 and the nozzle surface of the print unit 11 on the interior side of the belt 40, which is set around the rollers 36 and 38, as shown in FIG. 1; and the suction chamber 42 provides suction with a fan 44 to generate a negative pressure, and the recording paper 14 is held on the belt 40 by suction.

The belt 40 is driven in the clockwise direction in FIG. 1 by the motive force of a motor (not shown in FIG. 1, but shown as a motor 214 in FIG. 5) being transmitted to at least one of the rollers 36 and 38, which the belt 40 is set around, and the recording paper 14 held on the belt 40 is conveyed from left to right in FIG. 1.

Since ink adheres to the belt 40 when a marginless print job or the like is performed, a belt-cleaning unit 46 is disposed in a predetermined position (a suitable position outside the printing area) on the exterior side of the belt 40. Although the details of the configuration of the belt-cleaning unit 46 are not depicted, examples thereof include a configuration in which the belt 40 is nipped with a cleaning roller such as a brush roller and a water absorbent roller, an air blow configuration in which clean air is blown onto the belt 40, or a combination of these. In the case of the configuration in which the belt 40 is nipped with the cleaning roller, it is preferable to make the line velocity of the cleaning roller different than that of the belt 40 to improve the cleaning effect.

The inkjet recording apparatus 10 can comprise a roller nip conveyance mechanism, in which the recording paper 14 is pinched and conveyed with nip rollers, instead of the suction belt conveyance unit 20. However, there is a drawback in the roller nip conveyance mechanism that the print tends to be smeared when the printing area is conveyed by the roller nip action because the nip roller makes contact with the printed surface of the recording paper 14 immediately after printing. Therefore, the suction belt conveyance in which nothing comes into contact with the image surface in the printing area of the recording paper 14 is preferable.

A heating fan 49 is disposed on the upstream side of the print unit 11 in the conveyance pathway formed by the suction belt conveyance unit 20. The heating fan 49 blows heated air onto the recording paper 14 to heat the recording paper 14 immediately before printing so that the ink deposited on the recording paper 14 dries more easily.

The print unit 11 forms a so-called full-line head in which print heads 50K, 50C, 50M, and 50Y (a line head) having a length that corresponds to the maximum paper width is disposed in the main scanning direction perpendicular to the delivering direction of the recording paper 14 (sub-scanning).

A specific structural example is described later, each of the print heads 50K, 50C, 50M, and 50Y is composed of a line head, in which a plurality of ink-droplet ejection apertures (nozzles) are arranged along a length that exceeds at least one side of the maximum-size recording paper 14 intended for use in the inkjet recording apparatus 10. The print heads 50K, 50C, 50M, and 50Y are arranged in order of black (K), cyan (C), magenta (M), and yellow (Y) from the upstream side along the paper conveyance direction. A color print can be formed on the recording paper 14 by ejecting the inks from the print heads 50K, 50C, 50M, and 50Y, respectively, onto the recording paper 14 while conveying the recording paper 14.

Although the configuration with the KCMY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

As shown in FIG. 1, the ink storing/loading unit 52 has tanks for storing the inks to be supplied to the print heads 50K, 50C, 50M, and 50Y, and the tanks are connected to the print heads 50K, 50C, 50M, and 50Y through channels (not shown), respectively. The ink storing/loading unit 52 has a warning device (e.g., a display device, an alarm sound generator) for warning when the remaining amount of any ink is low, and has a mechanism for preventing loading errors among the colors.

The print determination unit 22 has an image sensor for capturing an image of the ink-droplet deposition result of the print unit 11, and functions as a device to check for ejection defects such as clogs of the nozzles in the print unit 11 from the ink-droplet deposition results evaluated by the image sensor.

A post-drying unit 24 is disposed following the print determination unit 22. The post-drying unit 24 is a device to dry the printed image surface, and includes a heating fan, for example. It is preferable to avoid contact with the printed surface until the printed ink dries, and a device which blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

The heating/pressurizing unit 60 is a device to control the glossiness of the image surface, and the image surface is pressed with a pressure roller 62 and 64 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48B and a round blade 48A.

Although not shown in FIG. 1, a sorter for collecting prints according to print orders is provided to the paper output unit 26A for the target prints. Additionally, a numeral 26B in FIG. 1 is test printed-paper output unit.

Next, the structure of the print heads is described. The print heads 50K, 50C, 50M, and 50Y provided for the ink colors have the same structure, and a reference numeral 50 is hereinafter designated to any of the print heads 50K, 50C, 50M, and 50Y.

Figure 2A:
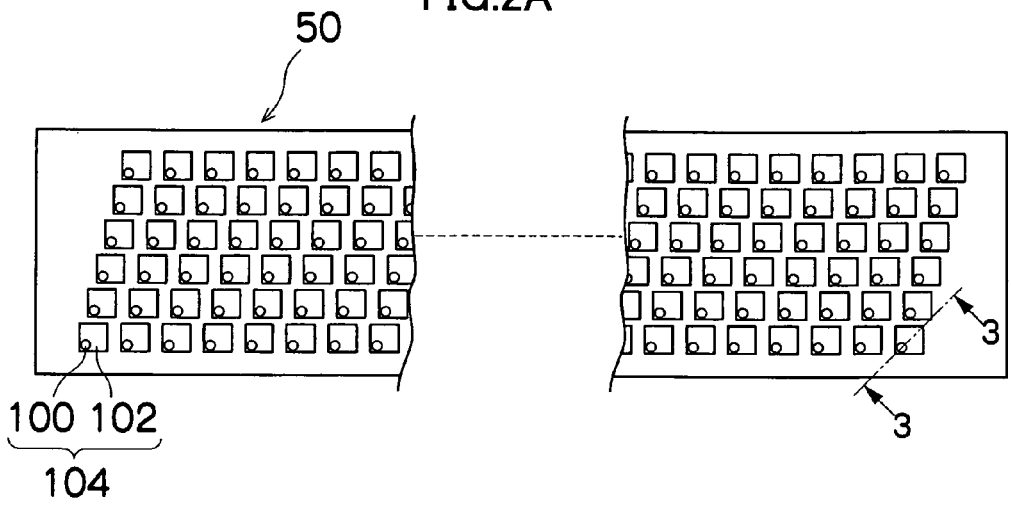
FIG. 2A is a perspective plan view showing an example of the configuration of a print head.
Figure 2B:
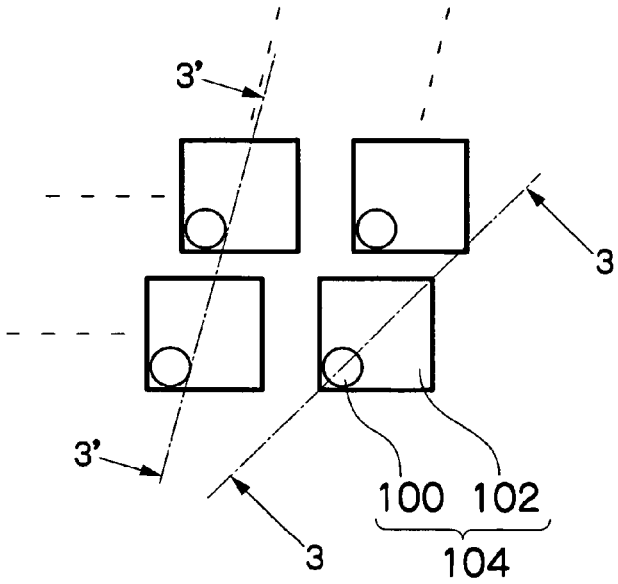
FIG. 2B is an enlarged view of a portion thereof.
Figure 2C:
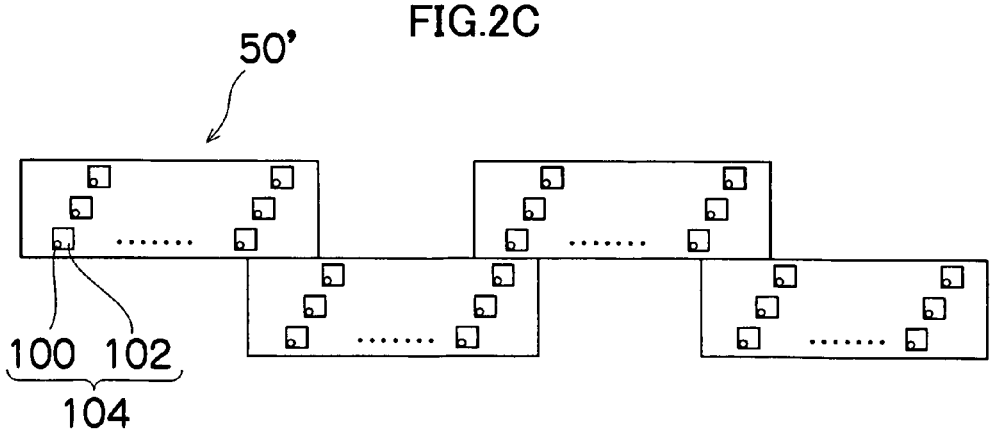
FIG. 2C is a perspective plan view showing another example of the configuration of a print head.
Figure 3:
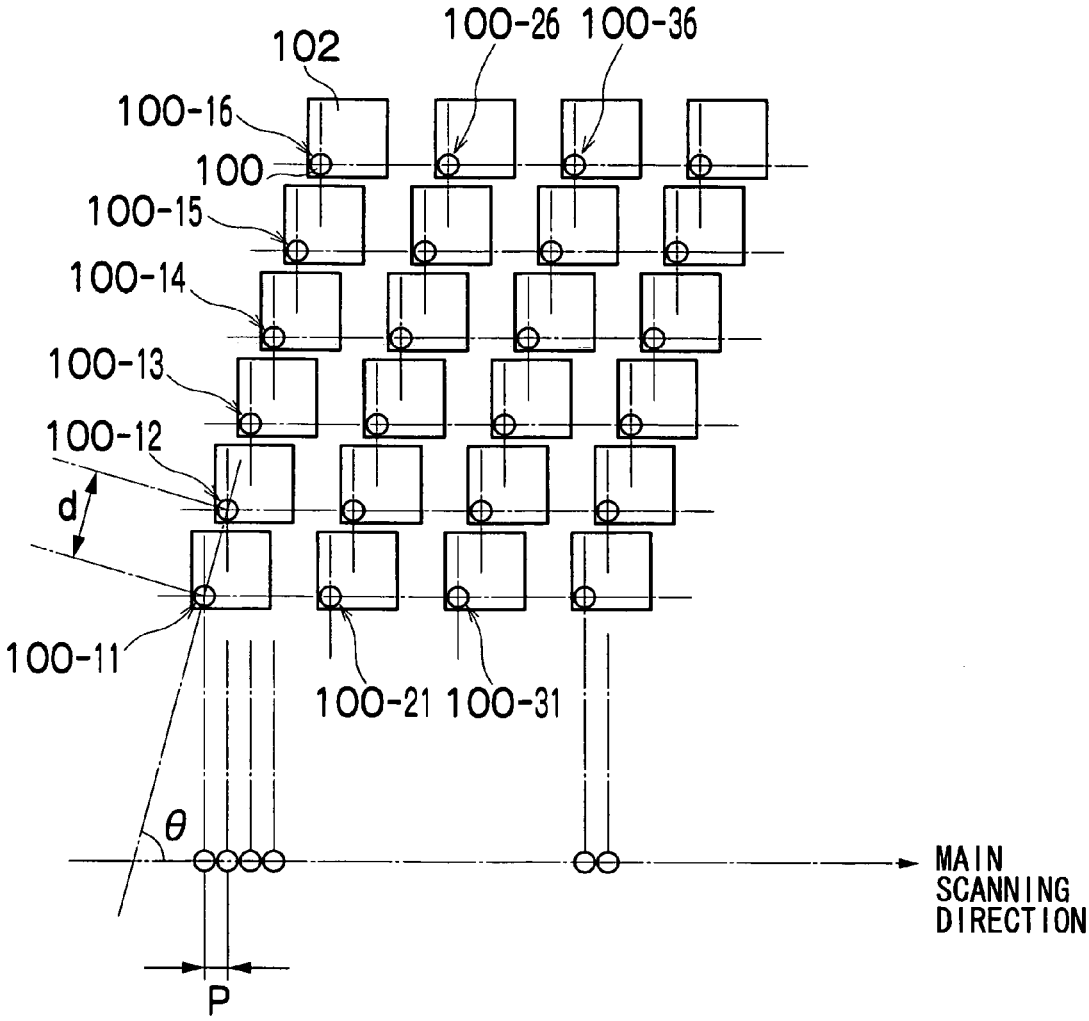
FIG. 3 is a schematic drawing showing a plurality of ink chamber units arranged in a matrix.

FIG. 2A is a perspective plan view showing an example of the configuration of the print head 50, FIG. 2B is an enlarged view of a portion thereof, and FIG. 2C is a perspective plan view showing another example of the configuration of the print head 50. FIG. 3 is a schematic drawing showing a plurality of ink chamber units arranged in a matrix. The nozzle pitch in the print head 50 should be minimized in order to maximize the density of the dots printed on the surface of the recording paper. As shown in FIGS. 2A, 2B, 2C, and 3, the print head 50 in the present embodiment has a structure in which a plurality of ink chamber units 104 including nozzles 100 for ejecting ink-droplets and pressure chambers 102 connecting to the nozzles 100 are disposed in the form of a staggered matrix, and the effective nozzle pitch is thereby made small.

Thus, as shown in FIGS. 2A and 2B, the print head 50 in the present embodiment is a full-line head in which one or more of nozzle rows in which the ink ejection nozzles 100 are arranged along a length corresponding to the entire width of the recording medium in the direction substantially perpendicular to the conveyance direction of the recording medium.

Alternatively, as shown in FIG. 2C, a full-line head can be composed of a plurality of short two-dimensionally arrayed head units 50' arranged in the form of a staggered matrix and combined so as to form nozzle rows having lengths that correspond to the entire width of the recording paper 14.

The plurality of ink chamber units 104 having such a structure are arranged in a grid with a fixed pattern in the line-printing direction along the main scanning direction and in the diagonal-row direction forming a fixed angle $\theta$ that is not a right angle with the main scanning direction, as shown in FIGS. 3A, 3B, and 3C. With the structure in which the plurality of rows of ink chamber units 104 are arranged at a fixed pitch d in the direction at the angle $\theta$ with respect to the main scanning direction, the nozzle pitch P as projected in the main scanning direction is $d \times \cos\theta$.

Hence, the nozzles 100 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch. For convenience in description, the structure is described below as one in which the nozzles 100 are arranged at regular intervals (pitch P) in a straight line along the lengthwise direction of the head 50 and 50', which is parallel with the main scanning direction.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 100 arranged in a matrix such as that shown in FIG. 3 are driven, the main scanning according to the above-described (3) is preferred. More specifically, the nozzles 100-11, 100-12, 100-13, 100-14, 100-15 and 100-16 are treated as a block (additionally; the nozzles 100-21, 100-22, . . . , 100-26 are treated as another block; the nozzles 100-31, 100-32, . . . , 100-36 are treated as another block, . . . ); and one line is printed in the width direction of the recording paper 14 by sequentially driving the nozzles 100-11, 100-12, . . . , 100-16 in accordance with the conveyance velocity of the recording paper 14.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other. In the implementation of the present invention, the structure of the nozzle arrangement is not particularly limited to the examples shown in the drawings.

Figure 4:
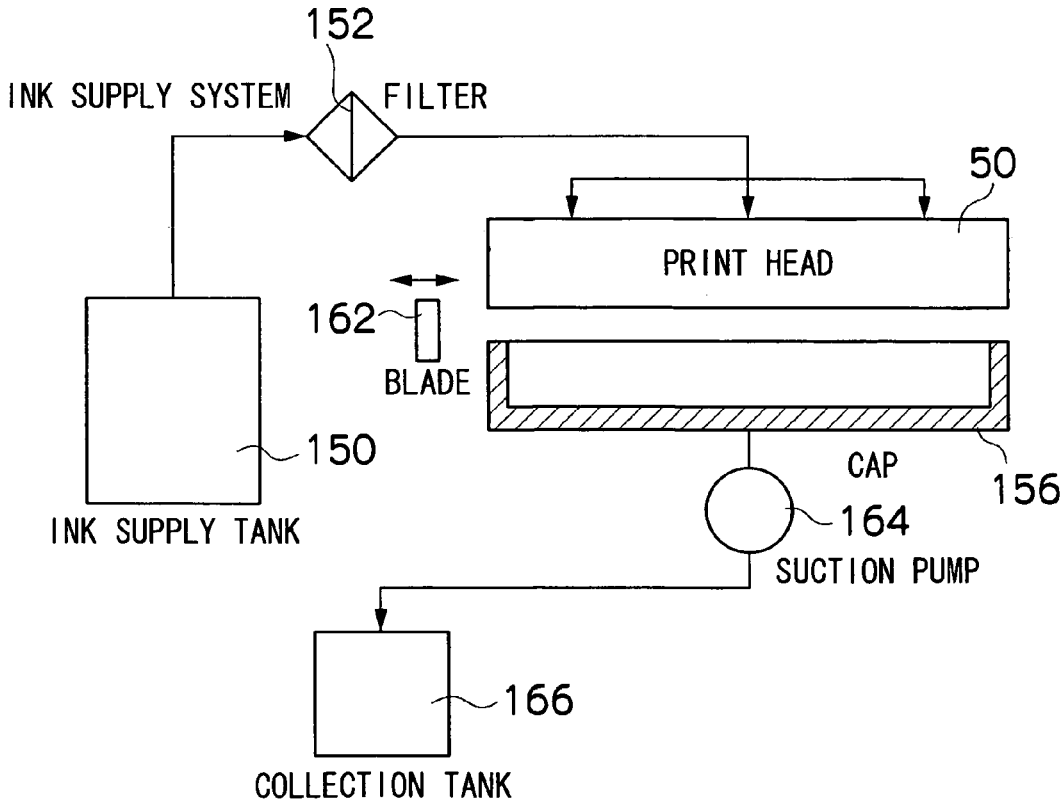
FIG. 4 is a schematic drawing showing the configuration of the ink supply system in the inkjet recording apparatus.

FIG. 4 is a schematic drawing showing the configuration of the ink supply system in the inkjet recording apparatus 10.

An ink supply tank 150 is a base tank that supplies ink and is set in the ink storing/loading unit 52 described with reference to FIG. 1. The aspects of the ink supply tank 150 include a refillable type and a cartridge type: when the remaining amount of ink is low, the ink supply tank 150 of the refillable type is filled with ink through a filling port (not shown) and the ink supply tank 150 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 150 in FIG. 4 is equivalent to the ink storing/loading unit 52 in FIG. 1 described above.

A filter 152 for removing foreign matters and bubbles is disposed between the ink supply tank 150 and the print head 50, as shown in FIG. 4. The filter mesh size in the filter 152 is preferably equivalent to or less than the diameter of the nozzle and commonly about 20 μm.

Although not shown in FIG. 4, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 156 as a device to prevent the nozzle 100 from drying out or to prevent an increase in the ink viscosity in the vicinity of the nozzles, and a cleaning blade 162 as a device to clean the nozzle face.

A maintenance unit including the cap 156 and the cleaning blade 162 can be moved in a relative fashion with respect to the print head 50 by a movement mechanism (not shown), and is moved from a predetermined holding position to a maintenance position below the print head 50 as required.

The cap 156 is displaced up and down in a relative fashion with respect to the print head 50 by an elevator mechanism (not shown). When the power of the inkjet recording apparatus 10 is switched OFF or when in a print standby state, the cap 156 is raised to a predetermined elevated position so as to come into close contact with the print head 50, and the nozzle face is thereby covered with the cap 156.

During printing or standby, when the frequency of use of specific nozzles 100 is reduced and a state in which ink is not ejected continues for a certain amount of time or longer, the ink solvent in the vicinity of the nozzle evaporates and ink viscosity increases. In such a state, ink can no longer be ejected from the nozzle 100 even if the piezo actuator is operated.

Before reaching such a state the piezo actuator is operated (in a viscosity range that allows ejection by the operation of the piezo actuator), and a preliminary ejection (purge, air ejection, liquid ejection) is made toward the cap 156 (ink receptor) to which the degraded ink (ink of which viscosity has increased in the vicinity of the nozzle) is to be ejected.

Also, when bubbles have become intermixed in the ink inside the print head 50, ink can no longer be ejected from the nozzle even if the actuator is operated. The cap 156 is placed on the print head 50 in such a case, ink (ink in which bubbles have become intermixed) inside the pressure chamber 102 is removed by suction with a suction pump 164, and the suction-removed ink is sent to a collection tank 166. This suction action entails the suctioning of degraded ink of which viscosity has increased (hardened) when initially loaded into the head, or when service has started after a long period of being stopped. The suction action is performed with respect to all the ink in the pressure chamber 102, so the amount of ink consumption is considerable. Therefore, a preferred aspect is one in which a preliminary ejection is performed when the increase in the viscosity of the ink is small.

The cleaning blade 162 is composed of rubber or another elastic member, and can slide on the ink ejection surface (surface of the nozzle plate) of the print head 50 by means of a blade movement mechanism (wiper, not shown). When ink droplets or foreign matter has adhered to the nozzle plate, the surface of the nozzle plate is wiped, and the surface of the nozzle plate is cleaned by sliding the cleaning blade 162 on the nozzle plate. When the unwanted matter on the ink ejection surface is cleaned by the blade mechanism, a preliminary ejection is carried out in order to prevent the foreign matter from becoming mixed inside the nozzles 100 by the blade.

Next, the control system of the inkjet recording apparatus 10 is described.

Figure 5:
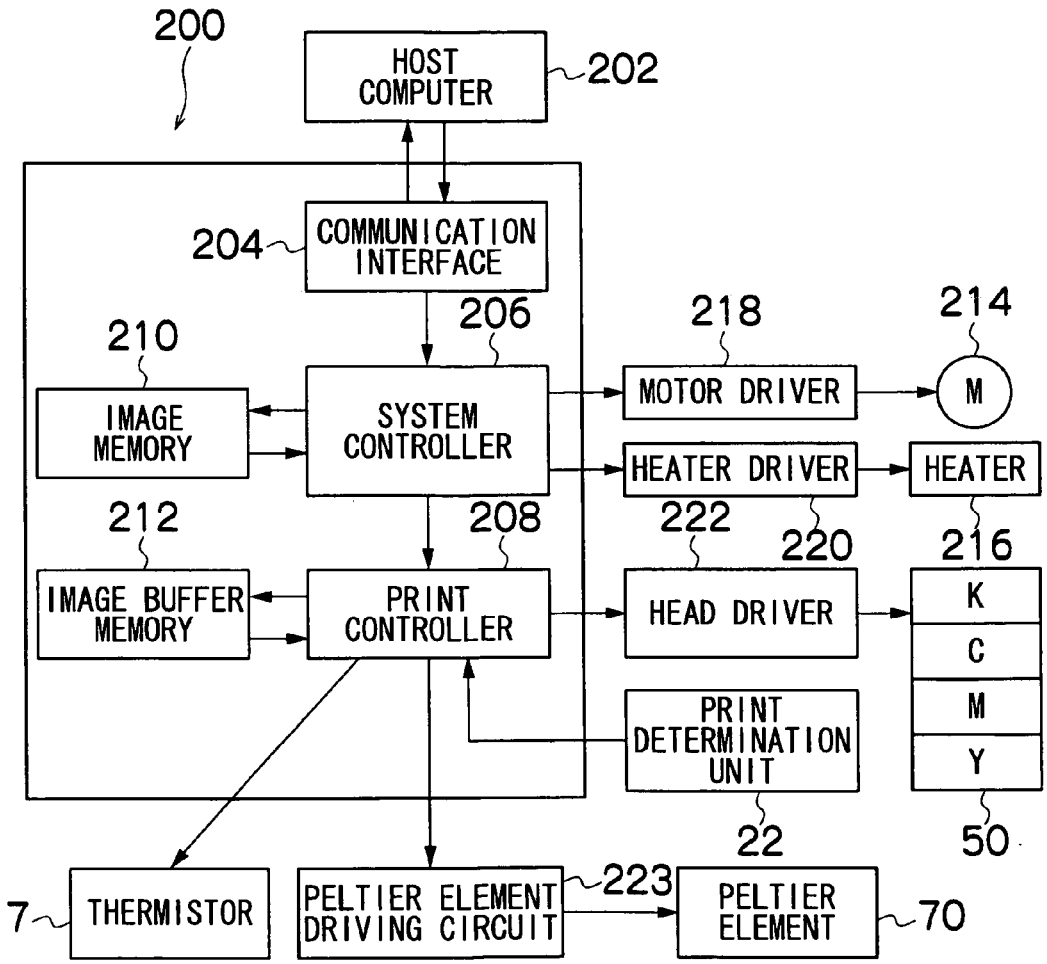
FIG. 5 is a block diagram of the principal components showing the system configuration of the inkjet recording apparatus.

FIG. 5 is a principal block diagram showing the system composition of the inkjet recording apparatus 10. The system control unit 200 of the inkjet recording apparatus 10 comprises: a communications interface 204 for acquiring data sent by a host computer 202; a system controller 206 for performing integrated control of the respective units on the basis of the image data; a print controller 208 (also referred to below simply as "controller 208") and image memory 210 for controlling the print heads; and an image buffer memory 212.

Image data sent from a host computer 202 is read into the inkjet recording apparatus 10 via the communications interface 204, and it is stored temporarily in the image memory 210. The image data thus read in is decompressed, and a conveyance system control signal for controlling the motor 214 of the suction belt conveyance unit 20 and the heater 216 is generated. The conveyance system control signal is supplied by the system controller 206 to the motor driver 218 and the heater driver 220.

In the print controller 208, the image data supplied from the image memory 210 is subjected to processing, such as various treatments, corrections, and the like, in order to output the image data to the print head 50. Necessary processing is carried out in the print controller 208, and the amount of ink ejected and the ejection timing in the print head 50 are controlled, via the head driver 222, on the basis of the image data. Furthermore, various corrections are made with respect to the print head 50, on the basis of information obtained from the print detection unit 22, according to requirements. An image buffer memory 212 for temporarily storing image data, parameters, and the like, during image data processing, is provided in the print controller 208.

For the communications interface 204, a serial interface, such as USB, IEEE 1394, the Internet, or a wireless network, or the like, or a parallel interface, such as Centronics, or the like, can be used.

The system controller 206 may be constituted by a CPU (computing unit), an image processing IC (digital signal processor (DSP)), and a memory controller, or it may be constituted by an IC (processor) which incorporates these functions in a single chip.

A random access memory (RAM) is used for the image memory 210, but it is also possible to use a magnetic medium, such as a hard disk, rather than a semiconductor element.

Here, an example is described in which an image buffer memory 212 is appended to the print controller 208, but it is also possible to make combine it with the image memory 210. Furthermore, it is also possible to use a memory incorporated into the processor used for the print controller 208.

The head driver 222 drives piezo actuators of the respective color heads according to the image data from the print controller 208. A feedback control system for maintaining uniform driving conditions in the heads may also be incorporated into the head driver 222.

The print determination unit 22 reads in the printed image, performs prescribed signal processing, and then determines the printing status, such as ejection failures, variations in droplet ejection, and the like, for each nozzle. The print determination unit 22 sends the results to the print controller 208.

Figure 6:
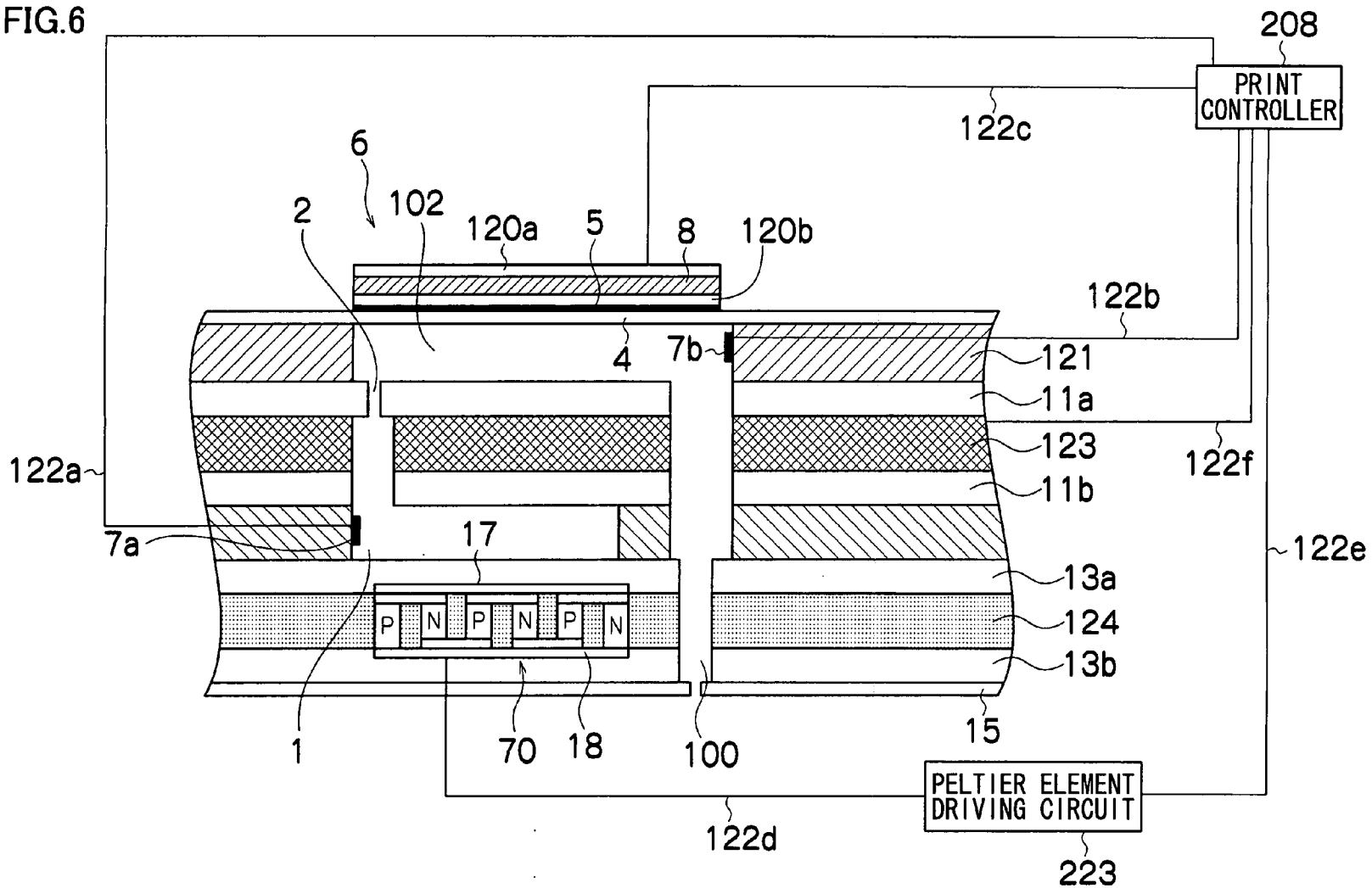
FIG. 6 is a conceptual diagram of an inkjet head according to a first embodiment of the present invention.

FIG. 6 is a cross-sectional diagram of an inkjet head along line 3—3 in FIG. 2B. This inkjet head is formed by using a plurality of laminated substrates. Ink is supplied to a pressure chamber 102 from a common flow passage 1 formed in the laminated substrates, via an ink supply port 2. A piezo element 6 is formed by a lower electrode layer 120b bonded via a bonding layer 5 to a vibration plate 4 that forms a portion of the pressure chamber 102, a piezo thin plate 8, and an upper electrode layer 120*a*. By applying a voltage to the upper electrode layer 120*a* and the lower electrode layer 120*b* from the controller 208, the vibration plate of the piezo element 6 is caused to bend due to a unimorph effect, and hence a pressure is generated inside the pressure chamber 102 and an ink droplet is ejected from the nozzle 100. Below, the part comprising the vibration plate 4, the bonding layer 5 and the piezo element 6 is called the piezo actuator.

The piezo actuator is formed by a vibration plate 4, a piezo element 6 comprising an upper electrode layer 120*a* and a lower electrode layer 120*b* formed by plating or sputtering on either side of a piezo thin plate 8 fabricated individually by a blast process, and a bonding layer 5 that bonds the vibration plate 4 and the piezo element 6 together. In the piezo actuator, a connecting wire 122*c* is connected to the upper electrode layer 120*a* and the lower electrode layer 120*b* by means of wire bonding, a flexible printed circuit (FPC), or the like. The connecting wire 122*c* is connected to the controller 208.

Thermistors 7*a* and 7*b* are installed respectively on the inside of the common flow passage 1 and the pressure chamber 102. The thermistors 7*a* and 7*b* respectively determine the temperature in the common flow passage 1 (hereafter, called T2) and the temperature in the pressure chamber 102 (hereafter, called T1). The thermistors 7*a* and 7*b* are respectively connected to the controller 208 by connecting wires 122*a* and 122*b*. As described below, the controller 208 keeps the temperature differential between the common flow passage 1 and the pressure chamber 102 within a prescribed temperature range, by controlling the driving of a heater 123 and a Peltier element 70. Drive power is supplied to the Peltier element 70 by a Peltier element driving circuit 223, and the controller 208 controls the driving of the Peltier element by controlling the supply of power from the Peltier element driving circuit 223. The heater 123 is bonded in a layer between the pressure chamber 102 and the common flow passage 1, by means of an ink supply port forming substrate 11*a* and a common flow passage upper substrate 11*b*. The heater 123 is connected to the controller 208 by the connecting wire 122*f*, and the thermal energy generated in the heater 123 by electrical resistance, or the like, is controlled by the amount of voltage supplied from the controller 208. In other words, the common liquid chamber upper substrate 11*b* that forms a partition between the pressure chamber 102 and the common flow passage 1 is heated by the heater 123.

The Peltier element 70 is bonded in a layer between the common flow passage 1 and the nozzle plate 15 in which the ejection port of the nozzle 100 is provided, via a common flow passage lower substrate 13*a* and an ejection flow passage forming substrate 13*b*, which are formed respectively by thermally conducting members. The perimeter of the Peltier element 70 is surrounded by a thermal insulating member 124 of ceramic, or the like. The Peltier element 70 is connected to the Peltier element driving circuit 223 by means of a connecting wire 122*d*, and the Peltier element driving circuit 223 is connected to the controller 208 by means of a connecting wire 122*e*. At a time interval of Ta, the controller 208 supplies a pulse current to the Peltier element driving circuit 223 during a time period Tb, and thereby controls the power supplied to the Peltier element 70 by the Peltier element driving circuit 223 in such a manner that the region where the Peltier element 70 is joined to the common flow passage lower substrate 13*a* (hereafter, called a first joint section 17) absorbs heat and the region where the Peltier element 70 is joined to the ejection flow passage forming substrate 13*b* (hereafter, called a second joint section 18) generates heats, or alternatively, in such a manner that the first joint section 17 generates heat and the second joint section absorbs heat. Hereafter, control performed by the controller 208 in order to heat or cool the first joint section 17 is respectively called "first heating control" and "first cooling control". Furthermore, control performed by the controller 208 in order to heat or cool the second joint section 18 is respectively called "second heating control" and "second cooling control".

When current is supplied from the Peltier element driving circuit 223 to the Peltier element 70 in accordance with first cooling control by the controller 208, the temperature falls in the first joint section 17 of the Peltier element 70. The amount of this temperature fall is dependent on the characteristics of the Peltier element 70, and is expressed as a temperature differential C between the first joint section 17 and the second joint section 18. Therefore, when a current is supplied from the Peltier element driving circuit 223 to the Peltier element 70 in accordance with first cooling control by the controller 208, the temperature differential between the first joint section 17 and the second joint section 18 becomes C. Furthermore, when a current is supplied from the Peltier element driving circuit 223 to the Peltier element 70 in accordance with first cooling control of the controller 208, the nozzle plate 15 is heated by the heat generated in the second joint section 18 that lies in contact with the nozzle plate 15. Therefore, the temperature in the vicinity of the ejection port of the nozzle 100 rises, and hence the viscosity of the ink in the vicinity of the ejection port can be reduced. Consequently, the ejection performance of ink of high viscosity can be improved. Below, ink of high viscosity is defined as ink having a viscosity of 50 mPas to 3000 mPas at 30° C., and desirably, a viscosity of 100 mPas to 500 mPas at 30° C. and a viscosity of 2 mPas to 30 mPas at 60° C. Furthermore, if the viscosity is 50 mPas or less at 30° C., then smudging of the image is liable to occur, whereas if the viscosity is 3000 mPas or greater, then uniformity of image quality will be lost. Moreover, if the ink viscosity is 30 mPas or greater at 60° C., then the ink ejection performance of the nozzle 100 is degraded, and therefore a viscosity of 2 mPas to 30 mPas is desirable, particularly if ejection is controlled by using a piezo actuator.

Figure 7:
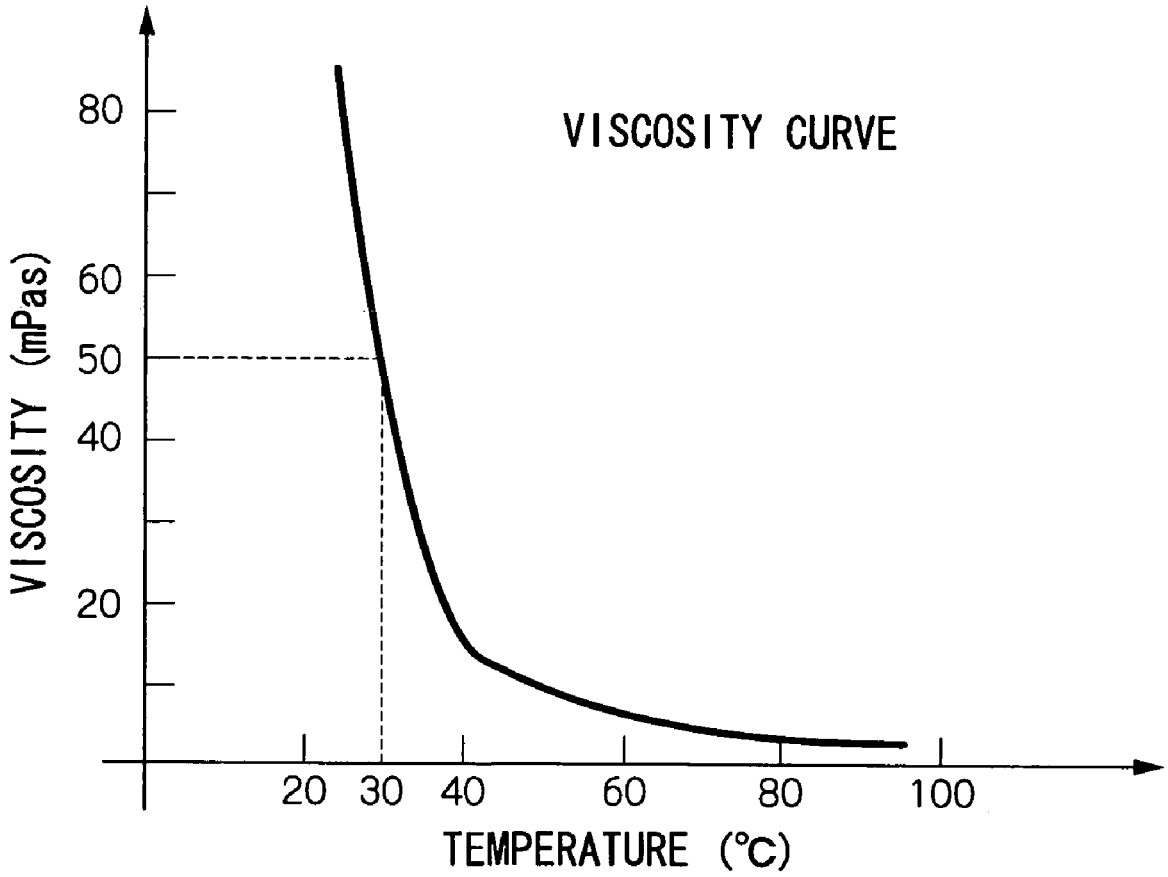
FIG. 7 is an example of an ink viscosity curve.
Figure 8:
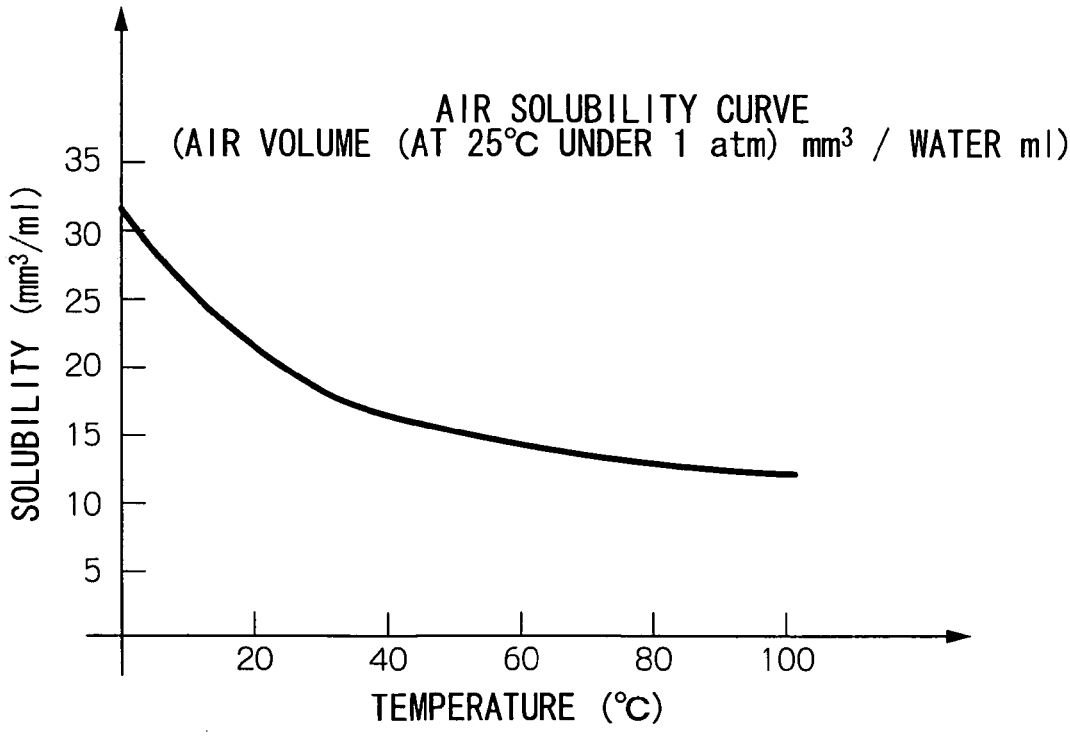
FIG. 8 is an example of a curve of air solubility in ink.

Next, the details of the control implemented by the controller 208 with respect to the Peltier element 70 and the heater 123 will be described. The controller 208 controls the Peltier element 70 and the heater 123 in such a manner that the temperature T1 of the pressure chamber 102 is kept at Tmax and the temperature T2 of the common flow passage 1 is kept at Tmin. Here, Tmax, Tmin and the differential ΔT between the temperatures Tmax and Tmin, (ΔT=Tmax−Tmin) are desirably determined in the following manner. Desirably, Tmax is determined by the relationship between temperature and the viscosity of the ink ejected from the nozzle 100, and by the solubility of air in the ink in response to temperature. For example, if the viscosity curve for a particular ink is such as that shown in FIG. 7, then desirably, Tmax is set to 30 to 100° C., where there is little change in viscosity with respect to temperature (in other words, where the viscosity is stable and ejection is able stable, irrespective of the temperature). However, if the air solubility curve for the ink is such as that shown in FIG. 8, then the air dissolved in the ink will form air bubbles at a temperature of 100° C. or above, and therefore a more desirable range for Tmax is 40 to 70° C. Furthermore, desirably, the differential ΔT is set to a temperature difference at which convection is produced in the common flow passage 1 due to the temperature difference between the ejection flow passage forming substrate 13*b* and the common liquid chamber upper substrate 11*b*, and generation of air bubbles in the common flow passage 1 is retarded. Furthermore, desirably, the differential ΔT is set in such a manner that the ink in the pressure chamber 102 is heated to Tmax within the time period from the supply of ink to the pressure chamber 102 from the common flow passage 1, to the point of ejection of the ink (hereafter, this time period is called the "ejection cycle"). For example, if ΔT is 10° C. or above, then there may be cases where the ink in the common flow passage 1 cannot be heated to Tmax within the ejection cycle. Therefore, desirably, ΔT is set to 10° C. or less, for example, ΔT is set to 5° C. Desirable values for Tmax and ΔT should be determined as described above, and the value of Tmin then decided from the relationship Tmin=Tmax−ΔT.

Figure 9:
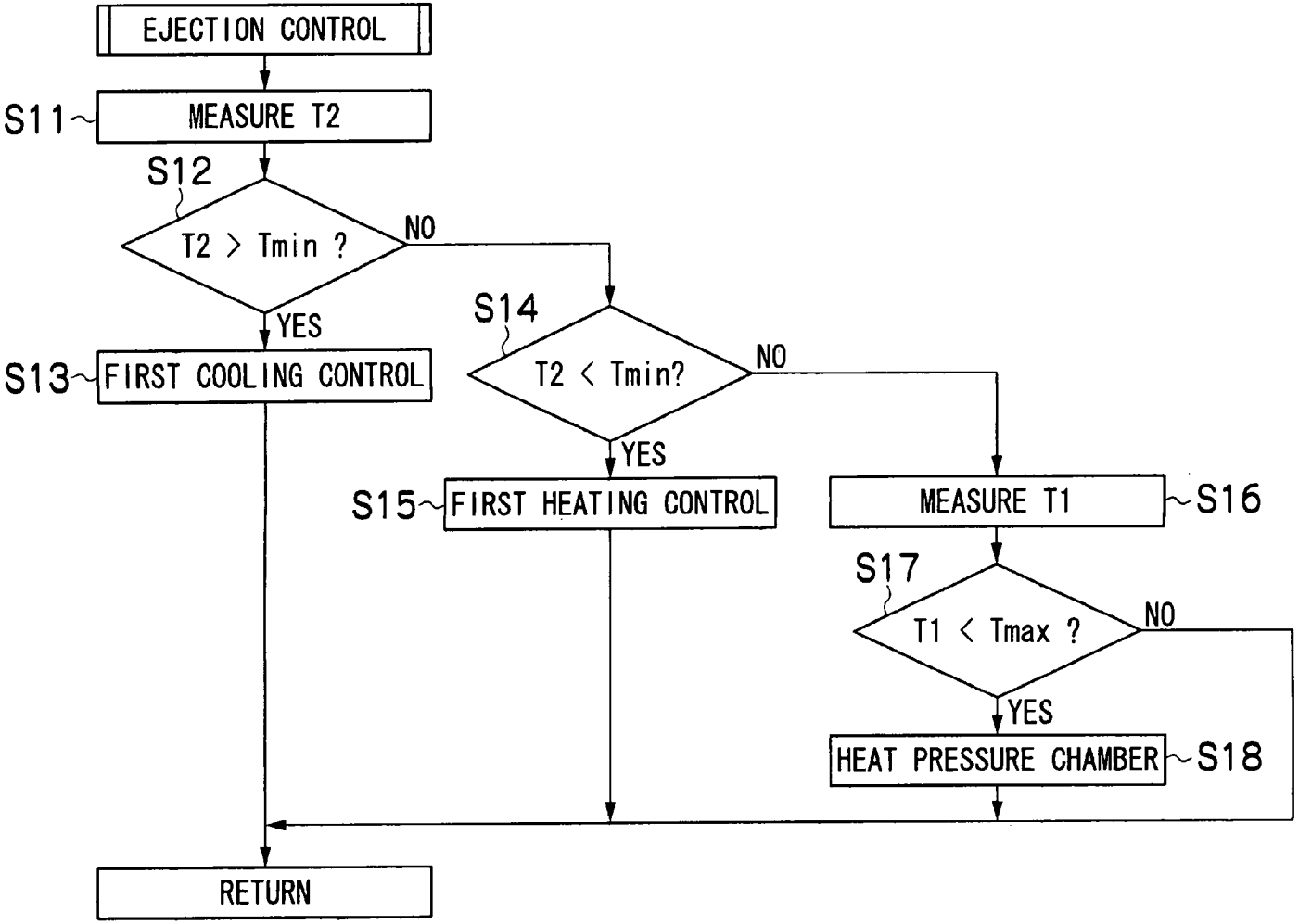
FIG. 9 is a flowchart of ejection control.

FIG. 9 is a flowchart showing the sequence of control implemented by the controller 208 when ink is being ejected from the nozzle 100, (hereafter called "ejection control") in order to make the temperature differential between the common flow passage 1 and the pressure chamber 102 assume a value of ΔT. At S11, the controller 208 acquires the current temperature T2 of the common flow passage 1 from the thermistor 7*a*. At S12, the controller 208 judges whether or not T2>Tmin. If T2>Tmin, then the sequence advances to S13, and if T2≦Tmin, then the sequence advances to S14. At S13, the controller 208 implements first cooling control. Accordingly, the first joint section 17 of the Peltier element 70 cools the lower face of the common flow passage 1 via the common flow passage lower substrate 13*a*, and the second joint section 18 of the Peltier element 70 heats the nozzle plate 15 via the ejection flow passage forming substrate 13*b*. At S14, the controller 208 judges whether or not T2<Tmin. If T2<Tmin, then the sequence advances to S15, and if T2≧Tmin, then the sequence advances to S16. At S15, the controller 208 implements first heating control. Accordingly, the first joint section 17 of the Peltier element 70 heats the lower face of the common flow passage 1 via the common flow passage lower substrate 13*a*.

At S16, the controller 208 acquires the current temperature T1 of the pressure chamber 102 from the thermistor 7*b*. At S17, the controller 208 judges whether or not T1<Tmax. If T1<Tmax, then the sequence advances to S18, and if T1≧Tmax, then the sequence advances to S11. At S18, the controller 208 performs control in such a manner that the heater 123 generates heat. The heater 123 heats the pressure chamber 102 via the ink supply port forming substrate 11*a*, and it also heats the upper face of the common flow passage 1 via the common flow passage upper substrate 11*b*. Desirably, the processing steps S11 to S18 are executed at least one within one ejection cycle, in order that the T1–T2 becomes substantially equal to ΔT within the ejection cycle. More desirably, these processing steps are repeated a plurality of time within one ejection cycle.

By means of the control sequence described above, the temperature differential between the lower face and the upper face of the common flow passage 1 becomes ΔT, and therefore convection can be produced inside the common flow passage 1, whilst retarding the generation of air bubbles inside the common flow passage 1. Furthermore, due to this temperature differential ΔT, the viscosity of the ink in the common flow passage 1 becomes greater than that of the ink in the pressure chamber 102. Consequently, it is possible to prevent reflux of ink from the pressure chamber 102 into the common flow passage 1 during ink ejection caused by the force generated by the piezo actuator. Furthermore, since the pressure chamber 102 is heated to a temperature of Tmax by the heater 123, ink of high viscosity can be ejected.

Figure 10:
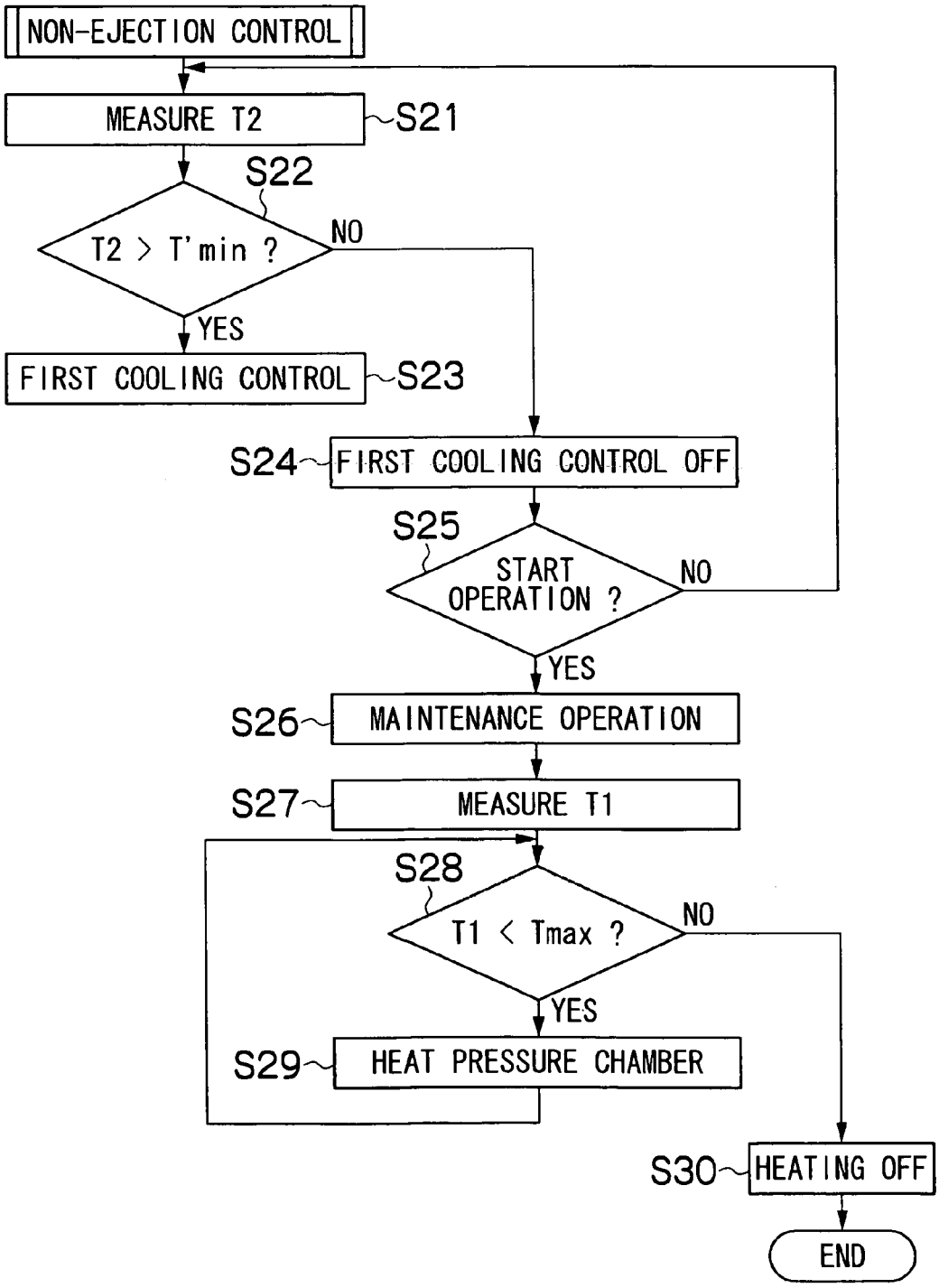
FIG. 10 is a flowchart of non-ejection control.

On the other hand, if the inkjet head is left unused for a long period of time, then the air that was dissolved in the ink remaining in the common flow passage 1 may form air bubbles. If it is attempted to operate the inkjet head again when air bubbles of this kind have formed, then the air bubbles may block the ink supply port 2 and hence ink may not be supplied to the pressure chamber 102, giving rise to the possibility of an ink ejection failure. Therefore, in the inkjet head according to the present embodiment, when no images are being recorded, control is implemented in order that the temperature of the common flow passage 1 is cooled to a temperature at which air bubbles do not form and at which any air bubbles that have entered from the upstream side of the common flow passage 1 can be dissolved into the ink (hereafter, this control is called "non-ejection control"). FIG. 10 is a flowchart showing the sequence of non-ejection control performed by the controller 208 when ink is not being ejected from the nozzle 100, for instance, when the inkjet head is assembled, left for a long period of time, or stored away. At S21, the controller 208 acquires the current temperature T2 of the common flow passage 1 from the thermistor 7*a*. At S22, the controller 208 judges whether or not T2>T'min. Here, if the air solubility curve for the ink is such as that shown in FIG. 8, then T'min is desirably set to 0 to 20° C. where a sufficient amount of air can be dissolved in the ink, and more desirably, it is set to 5 to 15° C. If T2>T'min, then the sequence advances to S23, and if T2≦T'min, then the sequence advances to S24. At S23, the controller 208 controls the Peltier element 70 in such a manner that the first joint section 17 is cooled (first cooling control). The first joint section 17 of the Peltier element 70 cools the common flow passage 1 via the common flow passage lower substrate 13*a*. At S24, the controller 208 controls the Peltier element 70 in such a manner that the cooling of the first joint section 17 is halted.

At S25, the controller 208 waits for a command to start the operation of the inkjet head (in other words, to start image recording), as issued by depressing a particular switch, or the like. If there has been an operation start command, then the sequence advances to S26, and if there has not been an operation start command, then it returns to S21. At S26, the controller 208 performs a prescribed maintenance operation, such as suction or purging, for the nozzle 100, and the ink remaining in the pressure chamber 102 is ejected from the nozzle 100 onto a prescribed position outside the recording medium.

At S27, the controller 208 acquires the current temperature T1 of the pressure chamber 102 from the thermistor 7*b*. At S28, the controller 208 judges whether or not T1<Tmax. If T1<Tmax, then the sequence advances to S29, and if T1≧Tmax, then the sequence advances to S30. At S29, the controller 208 performs control in such a manner that the heater 123 generates heat. The heater 123 heats the pressure chamber 102 via the ink supply port forming substrate 11*a*, and it also heats the upper face of the common flow passage 1 via the common flow passage upper substrate 11*b*. At S30, the controller 208 halts the heating operation of the heater 123.

By means of the control sequence described above, when the inkjet head is assembled or when it is left for a long period of time, it is possible to make air become dissolved in the ink by cooling the common flow passage 1 to T'min. The ink containing dissolved air can be expelled by means of a prescribed maintenance operation.

When ink is first replenished into the inkjet head, by replacing the ink cartridge, for instance, the controller 208 may implement control of the following kind. Namely, the controller 208 causes the heater 123 to generate heat, and hence the ink supply port forming substrate 11*a* and the common flow passage upper substrate 11*b* are heated and the wetting characteristics of the ink during replenishment are improved. Therefore, the ink can be replenished without air bubbles adhering to the ink supply port 2.

The Second Embodiment of the Present Invention

Figure 11:
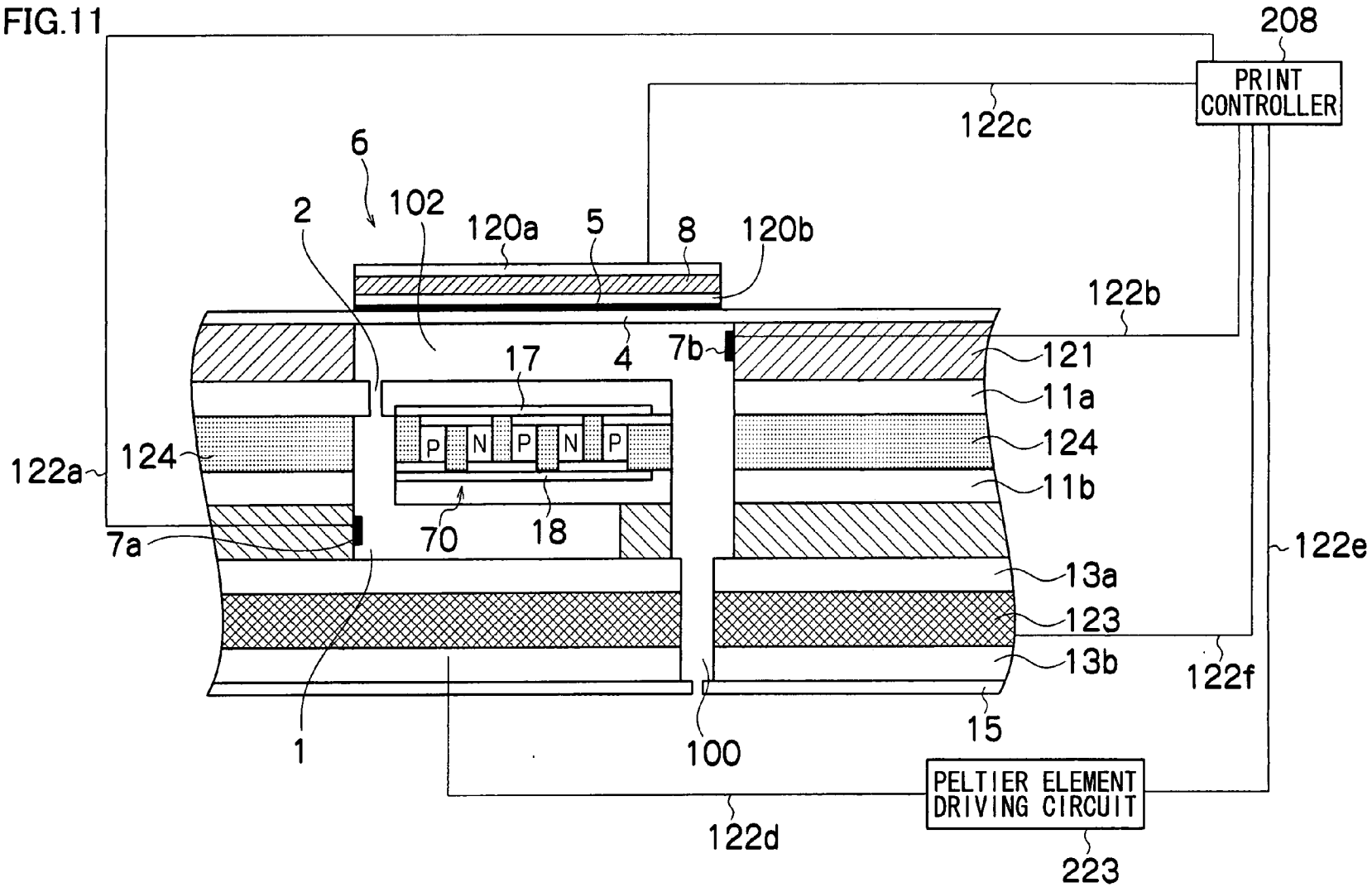
FIG. 11 is a conceptual diagram of an inkjet head according to a second embodiment of the present invention.

FIG. 11 is a general schematic drawing of an inkjet head according to another preferred embodiment of the present invention. Parts which are the same as those in the first embodiment are labeled with the same reference numerals as FIG. 6. In the present embodiment, in contrast to the first embodiment, a Peltier element 70 is provided in a layer between the pressure chamber 102 and the common flow passage 1. A first joint section 17 of the Peltier element 70 is joined to the lower face of the pressure chamber 102 via the ink supply port forming substrate 11*a*, and a second joint section 18 of the Peltier element 70 is joined to the upper face of the common flow passage 1 via the common flow passage upper substrate 11*b*. The regions of the Peltier element 70 apart from the first joint section 17 and the second joint section 18 are surrounded by a thermal insulating member 124. The heater 123 is bonded in a layer between the nozzle plate 15 and the common flow passage 1, via the common flow passage lower substrate 13*a* and the ejection flow passage forming substrate 13*b*. The heater 123 is connected to the controller 208 by means of a connecting wire 122*f* and is controlled by the controller 208. The Peltier element 70 is connected to a Peltier element driving circuit 223 by means of a connecting wire 122*d*, and the Peltier element driving circuit 223 is connected to the controller 208 by means of a connecting wire 122*e*.

The inkjet head having the composition illustrated in FIG. 11 is able to perform similar control to the ejection control of the first embodiment, but it differs in the following respects. At S13, the controller 208 controls the Peltier element 70 in such a manner that the second joint section 18 is cooled (second cooling control). At S15, the controller 208 controls the Peltier element 70 in such a manner that the second joint section 18 is heated (second heating control). At S18, the controller 208 controls the Peltier element 70 in such a manner that the first joint section 17 is heated (first heating control). By means of the control sequence described above, the temperature differential between the common flow passage 1 and the pressure chamber 102 becomes ΔT, and therefore convection can be produced inside the common flow passage 1, whilst retarding the generation of air bubbles inside the common flow passage 1.

Furthermore, the inkjet head having the composition illustrated in FIG. 11 is able to perform similar control to the non-ejection control of the first embodiment, but it differs in the following respects. At S21, the controller 208 acquires the current temperature T1 of the pressure chamber 102 from the thermistor 7*b*. At S22, the controller 208 judges whether or not T1>T'min. If T1>T'min, then the sequence advances to S23, and if T1≦T'min, then the sequence advances to S24. At S23, the controller 208 controls the Peltier element 70 in such a manner that the first joint section 17 is cooled (first cooling control). The first joint section 17 of the Peltier element 70 cools the pressure chamber 102 via the ink supply port forming substrate 11*a*. At S24, the controller 208 controls the Peltier element 70 in such a manner that the cooling of the first joint section 17 is halted.

At S28, the controller 208 judges whether or not T1<Tmax. If T1<Tmax, then the sequence advances to S29, and if T1≧Tmax, then the sequence advances to S30. At S29, the controller 208 controls the Peltier element 70 in such a manner that the first joint section 17 is heated (first heating control). Accordingly, the first joint section 17 of the Peltier element 70 heats the pressure chamber 102 via the ink supply port forming substrate 11*a*. At S30, the controller 208 controls the Peltier element 70 in such a manner that the heating of the first joint section 17 is halted.

By means of the control sequence described above, when the inkjet head is assembled or when it is left for a long period of time, it is possible to make air become dissolved in the ink by cooling the pressure chamber 102 to T'min. The ink containing dissolved air can be expelled by means of a prescribed maintenance operation.

The Third Embodiment of the Present Invention

Figure 12:
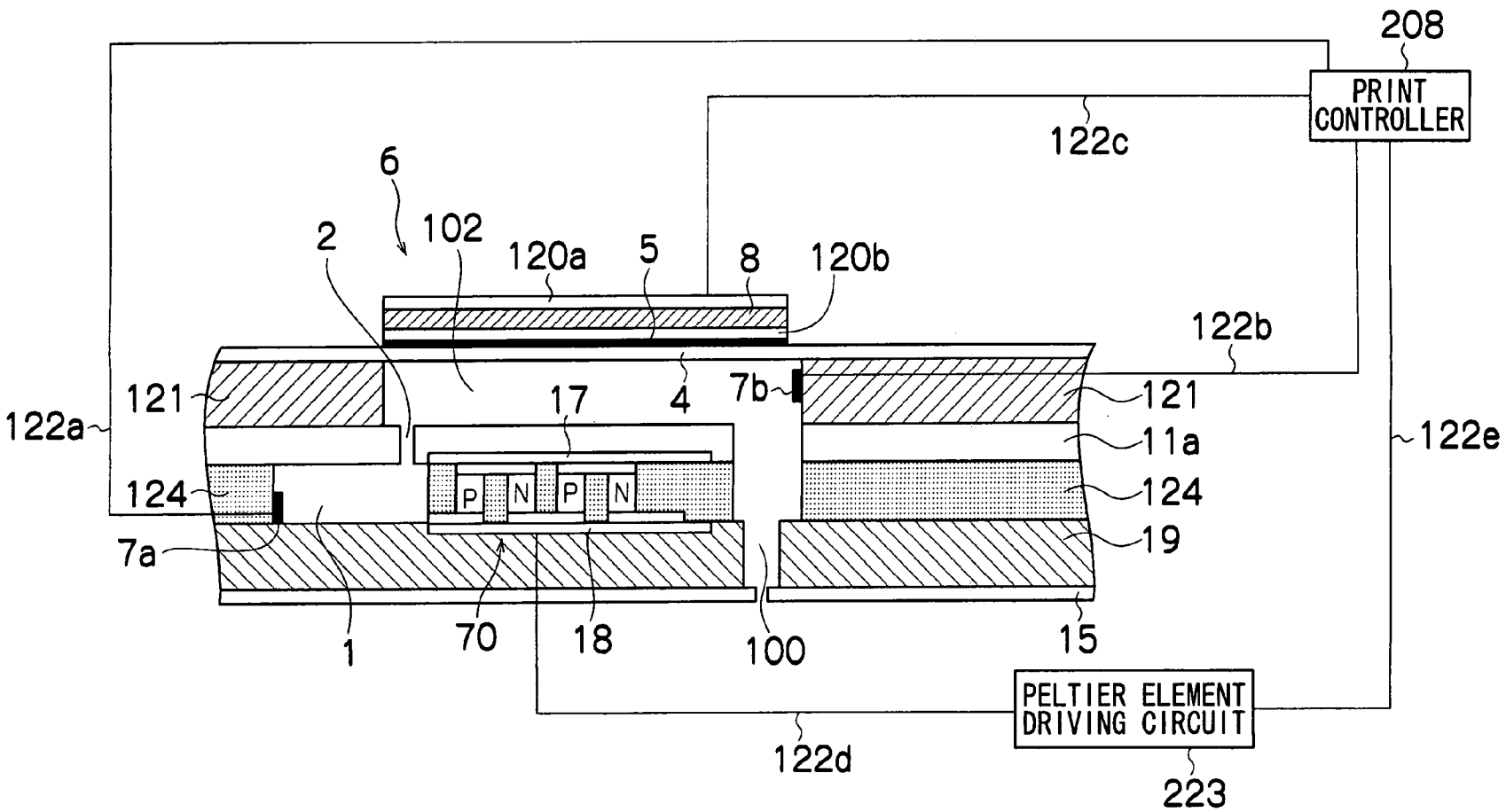
FIG. 12 is a conceptual diagram of an inkjet head according to a third embodiment of the present invention.

FIG. 12 is a general schematic drawing of an inkjet head according to another preferred embodiment of the present invention. Parts which are the same as those in the first embodiment are labeled with the same reference numerals as FIG. 6. In this embodiment, in contrast to the first embodiment, the first joint section 17 of the Peltier element 70 is joined to the lower face of the pressure chamber 102, via the ink supply port forming substrate 11*a*. The second joint section 18 of the Peltier element 70 is joined to the upper face of a thermal conducting member 19 made of SUS (Steel Use Stainless), or the like. The regions of the Peltier element 70 apart from the first joint section 17 and the second joint section 18 are surrounded by a thermal insulating member 124. The lower face of the thermal conducting member 19 is joined to a nozzle plate 15 in which the ejection port of the nozzle 100 is provided.

The inkjet head according to the present embodiment is able to carry out similar processing to the ejection control of the first embodiment (with the exception of Second joint section 18), but in this case, the temperature differential between the pressure chamber 102 and the common flow passage 1 is made to equal a value of approximately C by means of heat conduction by the thermal conducting member 19. More specifically, since the pressure chamber 102 is heated to a higher temperature and the common flow passage 1 is cooled to a lower temperature, then it is possible to prevent air bubbles from adhering to the supply port 2.

The Fourth Embodiment of the Present Invention

Figure 13:
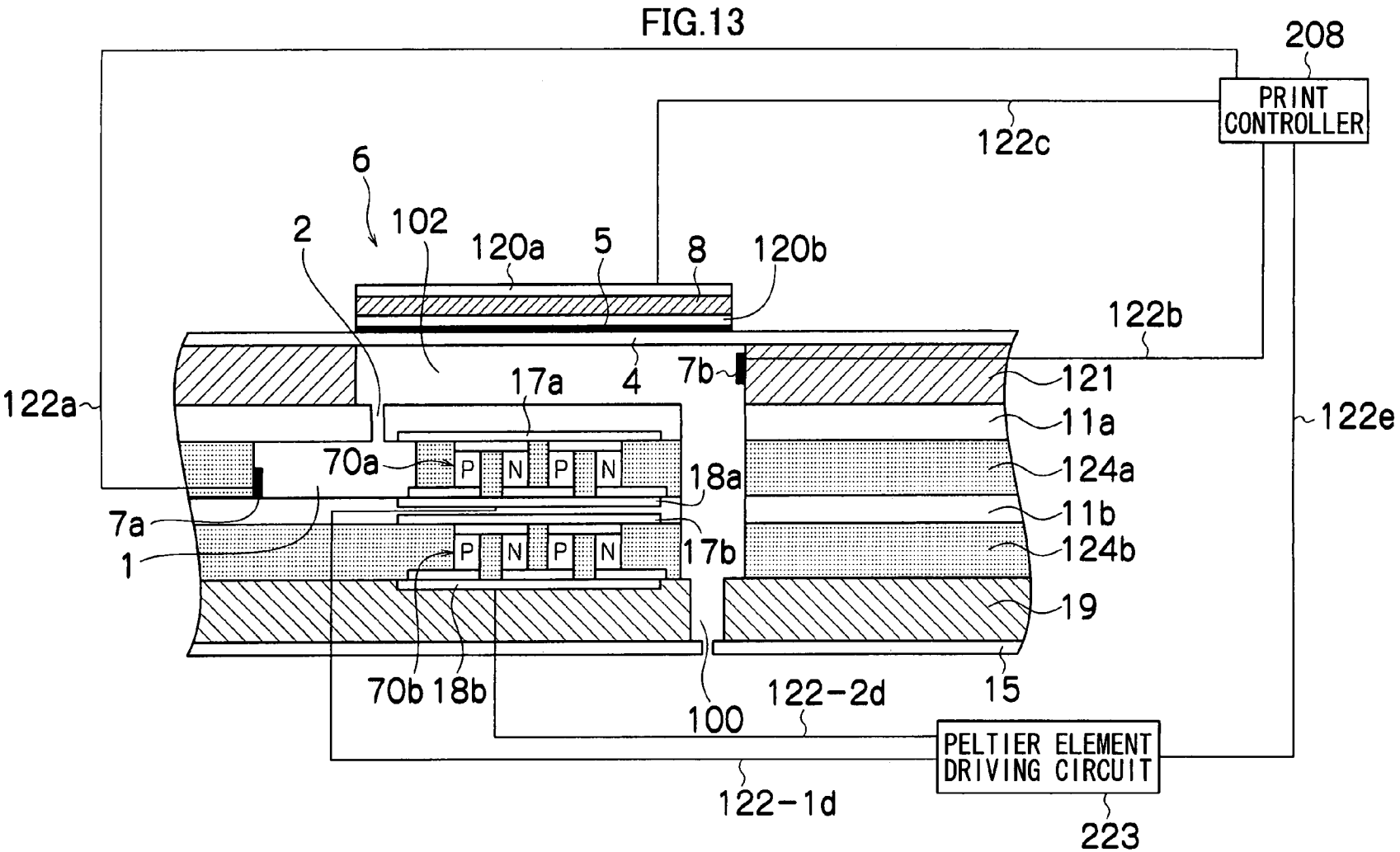
FIG. 13 is a conceptual diagram of an inkjet head according to a fourth embodiment of the present invention.

FIG. 13 is a general schematic drawing of an inkjet head according to another preferred embodiment of the present invention. Parts which are the same as those in the first embodiment are labeled with the same reference numerals as FIG. 6. In the present embodiment, similarly to the third embodiment (see FIG. 12), a common flow passage 1 is formed in a layer below the pressure chamber 102, via an ink supply port forming substrate 11*a*. On the other hand, a first joint section 17*a* of a first Peltier element 70*a* is joined to the lower face of the pressure chamber 102 via the ink supply port forming substrate 11*a*, and a second joint section 18*a* of the first Peltier element 70*a* is joined to the upper face of a common flow passage upper substrate 11*b*. The first Peltier element 70*a* is disposed in the same layer as the common flow passage 1. The regions of the first Peltier element 70*a* apart from the first joint section 17*a* and the second joint section 18*a* are surrounded by a thermal insulating member 124*a*. A first joint section 17*b* of the second Peltier element 70*b* is joined to the lower face of the common flow passage upper substrate 11*b*. In other words, the common flow passage upper substrate 11*b* is sandwiched between the first Peltier element 70*a* and the second Peltier element 70*b*. The second joint section 18*b* of the second Peltier element 70*b* is joined to the upper face of a thermal conducting member 19 made of SUS (Steel Use Stainless), or the like. The lower face of the thermal conducting member 19 is joined to a nozzle plate 15. The regions of the second Peltier element 70*b* apart from the first joint section 17*b* and the second joint section 18*b* are surrounded by a thermal insulating member 124*b*.

The first Peltier element 70*a* is connected to a Peltier element driving circuit 223 by means of a connecting wire 122-1*d*, and the second Peltier element 70*b* is connected to the Peltier element driving circuit 223 by means of a connecting wire 122-2*d*.

In the inkjet head according to the present embodiment, the controller 208 is able to implement similar control to the ejection control of the first embodiment, but it differs in the following respects. More specifically, at S13, the controller 208 controls the Peltier element 70*a* in such a manner that the second joint section 18*a* is cooled, while controlling the Peltier element 70*b* in such a manner that the first joint section 17*b* is cooled. At S15, the controller 208 controls the Peltier element 70*a* in such a manner that the second joint section 18*a* is heated, while controlling the Peltier element 70*b* in such a manner that the first joint section 17*b* is heated. At S18, the controller 208 controls the Peltier element 70*a* in such a manner that the first joint section 17*a* is heated. The other processing steps apart from these are similar to those in the first embodiment.

Furthermore, the controller 208 is able to implement similar control to the non-ejection control of the second embodiment, but it differs in the following respects. More specifically, at S23, the controller 208 controls the Peltier element 70*a* in such a manner that the first joint section 17*a* is cooled. At S29, the controller 208 controls the Peltier element 70*a* in such a manner that the first joint section 17*a* is heated. The other processing steps apart from these are similar to those in the second embodiment.

Here, taking the temperature differential between the first joint section 17*a* and the second joint section 18*a* which is determined by the characteristics of the Peltier element 70*a*, as Ca, and the temperature differential between the first joint section 17*b* and the second joint section 18*b* which is determined by the Peltier element 70*b*, as Cb, then it is possible to ensure that the temperature differential between the ink supply port forming substrate 11*a* and the thermal conducting member 19 is a maximum of |Ca+Cb|, and the temperature differential between the ink supply port forming substrate 11*a* and the common flow passage upper substrate 11*b* (in other words, the temperature differential between the common flow passage 1 and the pressure chamber 102) is a maximum of |Ca−Cb|. Consequently, it is possible to implement control in order readily to create a prescribed temperature differential between the common flow passage 1 and the pressure chamber 102, and between the pressure chamber 102 and the thermal conducting member 19. Furthermore, it is also possible to heat the nozzle plate 15 by means of the second joint section 18*b* of the Peltier element 70*b*, via the thermal conducting member 19. In this case, it is possible to lower the viscosity of the ink by raising the temperature in the vicinity of the ejection port of the nozzle 100. Therefore, ink of high viscosity can be ejected from the nozzle 100.

The Fifth Embodiment of the Present Invention

Figure 14:
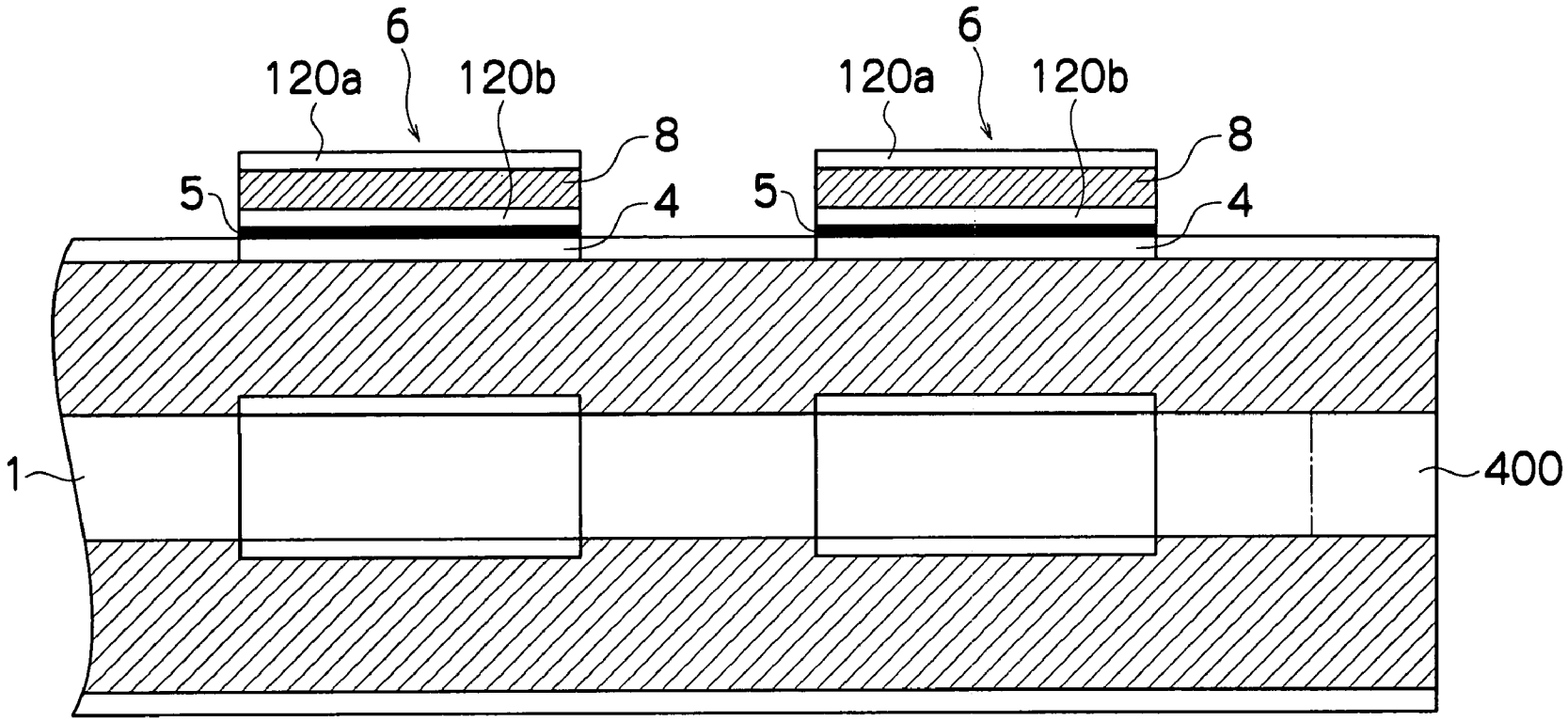
FIG. 14 is a cross-sectional diagram of an inkjet head according to a fifth embodiment of the present invention.

FIG. 14 is a cross-sectional diagram along line 3'—3' in FIG. 2B. As shown in FIG. 14, the common flow passage 1 is connected to a main flow 400 that is connected to an ink supply tank 150, and the common flow passage 1 receives a supply of ink from the main flow 400. Similarly to FIG. 12, a piezo actuator 6 comprising a vibration plate 4, a bonding layer 5 and a piezo element 8 having electrode layers 120 is joined to a layer above the common flow passage 1. The electrode layers 120 of the piezo actuator, thermistors 7*a* and 7*b* provided respectively in the common flow passage 1 and the pressure chamber 102, and the Peltier element 70 are all connected to the controller 208, similarly to FIG. 12. In respect of the direction in which the common flow passage 1 extends away from the main flow 400 (hereafter, called the downstream direction), the thermistor 7*a* is disposed in an approximately central position between an upstream position, namely, a position in the common flow passage 1 at a point nearest to the main flow 400, and a downstream position, namely, a position in the common flow passage 1 at a point furthest from the main flow 400. In the cross-sectional diagram along line 3—3 of FIG. 2B, similarly to FIG. 12, the common flow passage 1 is connected to respective supply ports 2 and a Peltier element 70 is provided in the same layer as the common flow passage 1.

The fluid resistance of the ink flowing along the common flow passage 1 increases due to the increase in the distance of the flow path, as the ink becomes more distant from the main flow 400. Therefore, the ink ejection performance from the nozzles 100 will vary in accordance with the distance separating the nozzle 100 from the main flow 400 in the downstream direction, and this variation will give rise to deterioration in the image. Therefore, the controller 208 according to the present embodiment implements control of the following kind. Namely, thermistors 7*a* are disposed along the common flow passage 1 that branches off from the main flow 400, at successively distanced positions from the main flow 400, and the temperature of the common flow passage 1 is controlled in accordance with the distance from the main flow 400 in the downstream direction, on the basis of the temperature determined by these thermistors 7*a*. For example, target temperatures which gradually increase from the main flow 400 in the downstream direction are previously set for the common flow passage 1, and the controller 208 controls the Peltier element 70 on the basis of these settings. Furthermore, it is also possible gradually to restrict the range of tolerance for the target temperature value in accordance with the distance in the downstream direction from the main flow 400 to the respective common flow passage 1, the Peltier element 70 being controlled on the basis of this range of tolerance. More specifically, if the temperature of the main flow 400 is set to a range of 30° C.±5% (30° C.±1.5° C.), then the ranges of tolerance at the respective installation positions of the thermistors 7*a* in the common flow passage 1 are set to 32° C.±3% at an upstream position, 35° C.±3% at an intermediate position, and 38° C.±3% at a downstream position. Furthermore, the range of tolerance for the temperature of the thermistor 7*b* and the interior of the pressure chamber 102 is set to 40° C.±1%. By adopting this configuration, in a common flow passage 1 which branches from a main flow 400 and is disposed in such a manner that it gradually becomes more distant from the main flow 400, it is possible to control the temperature of the common flow passage 1 in such a manner that it converges gradually to a target temperature, along the course of the common flow passage 1. Furthermore, temperature fluctuations inside the common flow passage 1 can be suppressed and hence ink ejection is stabilized. Desirably, the temperature differential between the main flow 400 and the pressure chamber 102 is 0.1 to 10° C., and more desirably, 1 to 5° C. If the temperature differential is 10° C. or above, then there is greater variation in the viscosity of the ink along the common flow passage 1 from the main flow 400 to the pressure chamber 102, and hence the ink supply is not stable and there is a risk that the image may degraded.

Similarly to the control described above, it is possible to implement the ejection control of the first embodiment, thereby keeping the temperature differential between the common flow passage 1 and the pressure chamber 102 within a prescribed temperature range.

The Sixth Embodiment of the Present Invention

Figure 15:
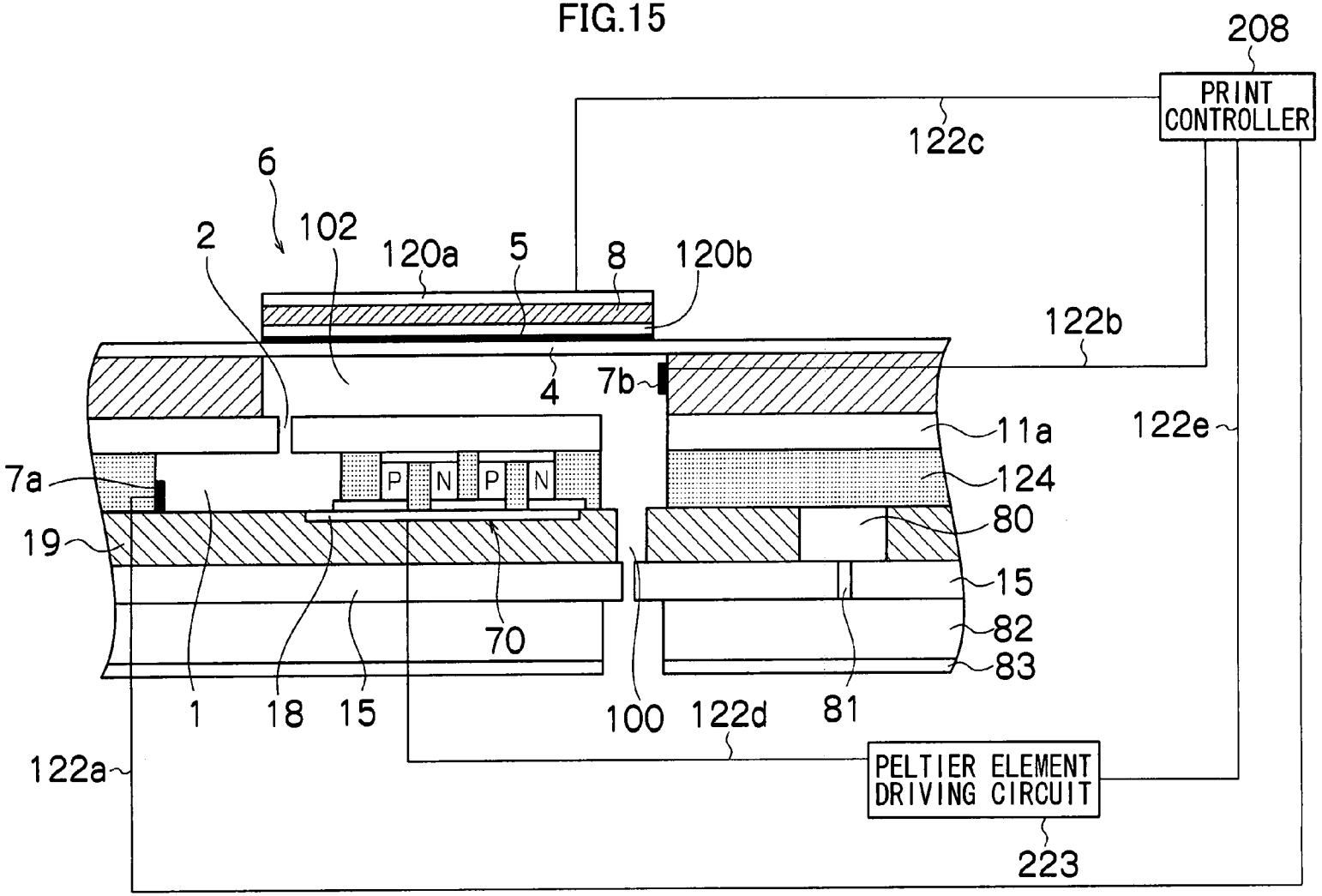
FIG. 15 is a conceptual diagram of an inkjet head according to a sixth embodiment of the present invention.

FIG. 15 is a general schematic drawing of an inkjet head according to another preferred embodiment of the present invention. Parts which are the same as those in the third embodiment are labeled with the same reference numerals as FIG. 12. In this embodiment, in contrast to the third embodiment, a supply tank 80 containing an ink evaporation preventing liquid is provided in the same layer as the thermal conducting layer 19 which is joined to the lower face of the Peltier element 70. A supply port 81 is provided in the lower portion of the supply tank 80, and the supply port 81 passes through a lower porous layer 82. The porous layer 82 extends up to the ejection port of the nozzle 100. The supply port 81 is opened and closed in accordance with the control implemented by the controller 208, and the ink evaporation preventing liquid (for example, water) is supplied to the vicinity of the ejection port of the nozzle 100 by passing along the porous layer 82. The lower face of the porous layer 82 is covered by a covering layer 83 which prevents evaporation of the ink evaporation preventing liquid.

The controller 208 is able to implement the similar control to that in steps S21 to S26 of the non-ejection control according to the second embodiment (see FIG. 10). However, the controller 208 may also implement control in order that the supply port 81 is opened and ink evaporation preventing liquid is supplied to the vicinity of the ejection port of the nozzle 100, particularly in cases where step S23 is performed repeatedly ("Y" at S22). On the other hand, if a printing operation has started ("Y" at S25), then the controller 208 may cause the supply port 81 to be closed, thereby halting the supply of the ink evaporation preventing liquid. In this way, by supplying an ink evaporation preventing liquid to the vicinity of the ejection port of the nozzle 100, it is possible to prevent ejection failures during image recording by the inkjet head as a result of the ink in the vicinity of the ejection port of the nozzle 100 having dried and increased in viscosity. By causing the porous layer 82 to become saturated with water, it is also possible to prevent the vicinity of the ejection port of the nozzle 100 from drying out as a result of evaporation of the water from the porous layer 82.

Moreover, if the controller 208 implements control in such a manner that the second joint section 18 of the Peltier element 70 is heated, then the nozzle plate 15 is heated via the thermal conducting layer 19 and the ink evaporation preventing liquid in the vicinity of the nozzle plate 15 evaporates. By means of this evaporation, it is possible to prevent the portion of the ink inside the nozzle 100 which is in contact with the air (namely, the "meniscus") from drying, and hence increase in the viscosity of the ink can be prevented. In the present embodiment, modes may be adopted in which drying of the nozzle meniscus is prevented by forming a porous layer on the ejection side of the nozzle plate 15 according to the first, second or fourth embodiments.

The Seventh Embodiment of the Present Invention

In the first to sixth embodiments, it is also possible for the piezo actuator to apply pressure to the pressure chamber 102 within a range that does not cause ink to be ejected, in such a manner that air bubbles inside the pressure chamber 102 are broken up and the air is caused to become dissolved inside the ink. Moreover, in the first to sixth embodiments, a method is employed in which an ink droplet is ejected means of the deformation of the actuator, which is typically a piezoelectric element, but in implementing the present invention, the method used for ejecting ink is not limited in particular. For instance, instead of a piezo jet method, it is also possible to apply various other types of methods, such as a thermal jet method in which the ink is heated and bubbles are caused to form in the ink by means of a heat generating body such as a heater, ink droplets being ejected by means of the pressure created by these bubbles.

The Eighth Embodiment of the Present Invention

An inkjet printer (image recording apparatus) comprising an inkjet head according to one of the first to seventh embodiments is also included in the present invention. The composition of the droplet ejection head and the image recording apparatus indicated in the foregoing embodiments is not limited to that of an inkjet head and an inkjet printer. For example, the present invention may also be applied to a liquid ejection head and a photographic image forming apparatus, in which a developer processing liquid is coated onto printing paper by means of a non-contact method. More specifically, the present invention can be applied to a broad range of other image forming apparatuses, which comprise a droplet ejecting step for coating a processing liquid, a functional liquid, or another type of liquid other than ink, onto a medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of nozzles which eject droplets of liquid;

a plurality of pressure chambers which are respectively connected to the nozzles;

a common flow passage which supplies the liquid to the pressure chambers;

a plurality of ejection devices which respectively cause the liquid in the pressure chambers to be ejected from the nozzles;

a temperature differential generating device which generates a temperature differential between the common flow passage and each of the pressure chambers;

a common flow passage temperature determining device which determines temperature of the common flow passage;

a pressure chamber temperature determining device which determines temperature of each of the pressure chambers; and a control device which controls the temperature differential generating device in accordance with the temperature of the common flow passage and the temperature of each of the pressure chambers, in such a manner that the temperature differential between the common flow passage and each of the pressure chambers reaches a prescribed temperature differential.

2. The liquid ejection head as defined in claim 1, wherein the temperature differential generating device comprises:

a pressure chamber heating device which heats each of the pressure chambers, the pressure chamber heating device being joined to one face of each of the pressure chambers; and a Peltier element of which heat absorbing face is joined to one face of the common flow passage.

3. The liquid ejection head as defined in claim 1, wherein the temperature differential generating device comprises a Peltier element disposed in a layer between the common flow passage and each of the pressure chambers, the Peltier element having a heat generating face which is joined to one face of each of the pressure chambers and a heat absorbing face which is joined to one face of the common flow passage.

4. The liquid ejection head as defined in claim 3, further comprising a nozzle heating device which heats a nozzle plate in which the nozzles are provided.

5. The liquid ejection head as defined in claim 1, wherein the temperature differential generating device comprises a first Peltier element disposed in a same layer as the common flow passage, the first Peltier element having a heat generating face which is joined to one face of each of the pressure chambers and a heat absorbing face which is joined to one face of a thermal conducting member connected to the common flow passage.

6. The liquid ejection head as defined in claim 5, wherein the temperature differential generating device further comprises a second Peltier element having a heat absorbing face which is joined to the other face of the thermal conducting member.

7. The liquid ejection head as defined in claim 1, further comprising:

a heating and cooling device which heats or cools the common flow passage, wherein:

the common flow passage branches from a main flow of a liquid flow passage which supplies the liquid; and the control device causes the common flow passage to be heated or cooled by controlling the heating and cooling device in such a manner that temperature at a prescribed position of the common flow passage reaches a prescribed target temperature according to a distance from the main flow to the prescribed position of the common flow passage.

8. The liquid ejection head as defined in claim 7, wherein the control device controls the heating and cooling device in such a manner that the temperature at the prescribed position of the common flow passage reaches a temperature within a temperature range according to the distance from the main flow to the prescribed position in the common flow passage.

9. The liquid ejection head as defined in claim 1, further comprising a liquid supply device which supplies a liquid for preventing evaporation of the liquid to be ejected, to a vicinity of an ejection port of each of the nozzles.

10. An image recording apparatus comprising the liquid ejection head as defined in claim 1.

* * * * *